US010337445B2

(12) United States Patent
Sanborn et al.

(10) Patent No.: US 10,337,445 B2
(45) Date of Patent: Jul. 2, 2019

(54) METHOD FOR OPERATING A DUAL FUEL INJECTION SYSTEM

(71) Applicant: Ford Global Technologies, LLC, Dearborn, MI (US)

(72) Inventors: Ethan D. Sanborn, Saline, MI (US); Joseph Lyle Thomas, Kimball, MI (US); Daniel Dusa, West Blloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 738 days.

(21) Appl. No.: 14/805,068

(22) Filed: Jul. 21, 2015

(65) Prior Publication Data

US 2017/0022926 A1 Jan. 26, 2017

(51) Int. Cl.

| | |
|---|---|
| ***F02D 41/38*** | (2006.01) |
| ***F02D 41/30*** | (2006.01) |
| ***F02M 55/02*** | (2006.01) |
| ***F02M 63/02*** | (2006.01) |
| *F02D 41/14* | (2006.01) |
| *F02D 41/00* | (2006.01) |

(52) U.S. Cl.

CPC ..... *F02D 41/3845* (2013.01); *F02D 41/3094* (2013.01); *F02M 55/025* (2013.01); *F02M 63/023* (2013.01); *F02M 63/0285* (2013.01); *F01P 2037/00* (2013.01); *F02D 41/005* (2013.01); *F02D 41/1446* (2013.01); *F02D 2041/3881* (2013.01); *F02D 2200/0602* (2013.01); *F02D 2200/0812* (2013.01)

(58) Field of Classification Search

CPC ..... F02D 2200/0812; F02D 2200/0806; F02D 2200/0808; F02D 2200/0814; F02D 2200/0816; F02D 2200/0818; F02D 41/3863; F02D 41/3872; F02D 2041/3881; F02D 41/3011; F02D 41/3076; F02D 41/3809

See application file for complete search history.

(56) References Cited

U.S. PATENT DOCUMENTS

| | | | |
|---|---|---|---|
| 5,712,274 | A | 1/1998 | Sueoka et al. |
| 5,839,412 | A | 11/1998 | Stockner et al. |
| 6,345,606 | B1 | 2/2002 | Ricci-Ottati et al. |

(Continued)

OTHER PUBLICATIONS

Sanborn, E. et al., "Method for Operating a Fuel Injection System," U.S. Appl. No. 14/805,139, filed Jul. 21, 2015, 57 pages.

*Primary Examiner* — David E Hamaoui
*Assistant Examiner* — Carl C Staubach
(74) *Attorney, Agent, or Firm* — Julia Voutyras; McCoy Russell LLP

(57) ABSTRACT

A method of operating an engine with dual fuel injection capabilities to address fuel rail over-pressure due to stagnating hot fuel is shown. The method comprises operating an engine cylinder with only port injection, and selectively activating and deactivating the second injector in response to a rail pressure increase of a fuel rail, the fuel rail coupled to the second injector, and deactivating the second injector in response to a rail pressure decrease of the fuel rail to a lower threshold determined based on engine operating conditions. In this way, degradation of the second injector may be reduced while maintaining a desired level of engine performance.

20 Claims, 5 Drawing Sheets

(56) References Cited

U.S. PATENT DOCUMENTS

| | | | | |
|---|---|---|---|---|
| 6,973,923 | B1 * | 12/2005 | Rodriguez | F02D 41/3836 123/446 |
| 7,500,469 | B2 * | 3/2009 | Akita | B60K 6/445 123/431 |
| 7,891,342 | B2 | 2/2011 | Dintino et al. | |
| 8,100,107 | B2 * | 1/2012 | Bidner | F02D 41/0025 123/299 |
| 8,118,006 | B2 | 2/2012 | Pursifull | |
| 8,306,723 | B2 | 11/2012 | Haskara et al. | |
| 8,485,160 | B2 | 7/2013 | Li et al. | |
| 2004/0007209 | A1 * | 1/2004 | Ohtani | F02D 41/062 123/431 |
| 2006/0207568 | A1 * | 9/2006 | Miyazaki | F02D 41/30 123/431 |
| 2009/0063018 | A1 | 3/2009 | Takeuchi et al. | |
| 2009/0320790 | A1 | 12/2009 | Lewis et al. | |
| 2010/0236528 | A1 * | 9/2010 | Elkolaly | F02D 41/042 123/459 |
| 2011/0265758 | A1 * | 11/2011 | Glugla | F02B 23/104 123/299 |
| 2013/0046454 | A1 | 2/2013 | Cowgill et al. | |
| 2013/0080032 | A1 * | 3/2013 | Kaneko | G01L 19/0092 701/103 |
| 2013/0218441 | A1 | 8/2013 | Thomas et al. | |
| 2014/0290597 | A1 | 10/2014 | Rumpsa et al. | |
| 2014/0316677 | A1 * | 10/2014 | Stockner | F02M 43/00 701/103 |

* cited by examiner

METHOD FOR OPERATING A DUAL FUEL INJECTION SYSTEM

BACKGROUND AND SUMMARY

Engines may be configured with various fuel systems used to deliver a desired amount of fuel to an engine for combustion. One type of fuel system includes a port fuel injector and a direct fuel injector for each engine cylinder. The port fuel injectors may be operated to improve fuel vaporization and reduce engine emissions, as well as to reduce pumping losses and fuel consumption at low loads. The direct fuel injectors may be operated during higher load conditions to improve engine performance and fuel consumption. Additionally, both port fuel injectors and direct fuel injectors may be operated together under some conditions to leverage advantages of both types of fuel delivery.

As such, there may be operating conditions where engines configured with dual fuel injection capabilities operate for an extended period with one of the injection systems inactive. For example, there may be conditions where the engine is operated with port injection only and the direct injectors are maintained inactive. The direct injectors may be coupled to a high-pressure fuel rail downstream of a high-pressure fuel pump. During the extended periods of non-operation of the direct injectors, the presence of a one-way check valve may result in high-pressure fuel being trapped in the high-pressure fuel rail. If the stagnating fuel is exposed to higher temperatures (such as higher ambient temperatures), the fuel may begin to expand and vaporize in the fuel rail, resulting in an increased fuel pressure, due to the closed and rigid nature of the fuel rail. This increased fuel temperature and pressure may in turn affect the durability of both the direct fuel injectors and related fuel hardware, in particular when the direct fuel injection system is enabled again.

One example attempt to address direct fuel injector degradation due to elevated fuel rail pressure includes activating an alternate injector in response to a fuel rail temperature increase. For example, in the approach shown by Rumpsa et al. in U.S. 2014/0290597, when operating an engine cylinder with fuel from a port fuel injector and not a direct injector, the direct injector is activated in response to a temperature increase of a direct injection fuel rail to above a threshold. The flow through the direct injector is activated for a predetermined amount of time, which in some examples is based on a predetermined injection mass.

However, the inventors herein have recognized potential problems with such an approach. As an example, activating the direct injector for a predetermined amount of time may result in fueling errors. Specifically, fuel rail pressure may fall below a minimum desired direct injection pressure, thereby resulting in unpredictable fuel injection masses. The fuel metering error may result in torque errors as well as undesirable exhaust soot emissions. Additionally, increasing the fuel rail pressure in response to the pressure falling below a minimum desired direct injection pressure may result in increased NVH and reduced energy efficiency, both of which are undesirable for a vehicle operator. Still further, injecting a predetermined amount of fuel (e.g., injecting for a predetermined amount of time or directly injecting a predetermined fuel mass) may include injecting with a large proportion of direct injection to port fuel injection, thereby resulting in degraded engine performance.

In one example, the issues described above may be addressed by a method comprising: while operating an engine cylinder with fuel from only a first injector, transiently activating the second injector to inject fuel into the cylinder in response to a fuel pressure increase at a fuel rail coupled to the second injector, and deactivating the second injector in response to a fuel pressure decrease at the fuel rail below a lower threshold, the lower threshold adjusted based on one or more engine operating conditions.

As one example, during conditions when an engine is operated with port injection only, a direct injector may be intermittently activated and deactivated to maintain a fuel pressure within a desired range. Specifically, while maintaining a high-pressure fuel pump disabled, engine direct injectors may be selectively activated when fuel pressure in the high-pressure direct injection fuel rail reaches an upper threshold. Fuel may be injected from the direct injectors until the fuel rail pressure reaches a lower threshold. Further, the lower threshold may be adjusted based on operating conditions while maintaining the lower threshold above a level where the high-pressure fuel pump needs to be re-enabled. For example, the lower threshold may be increased when engine operating conditions indicate that port fuel injection is preferred for engine performance, such as during cold ambient conditions, or when the exhaust soot load is already elevated. When the lower threshold is increased, relatively less fuel may be delivered from the direct injectors to the cylinder, while relatively more fuel may be delivered via the port injectors to the cylinder. Alternatively, the lower threshold may be decreased when engine operating conditions indicate that at least some direct injection is desired, such as when an engine's propensity for pre-ignition is higher, or when the alcohol content of the injected fuel is higher. When the lower threshold is decreased, relatively more fuel may be delivered from the direct injectors to the cylinder, while relatively less fuel may be delivered via the port injectors to the cylinder. In this way, direct injector degradation may be reduced, while still maintaining a desired level of engine performance achieved by delivering fuel to the engine via port injectors.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTIONS OF THE DRAWINGS

FIG. 1 schematically depicts an example embodiment of a cylinder of an internal combustion engine.

FIG. 2 schematically depicts an example embodiment of a fuel system coupled to an engine having dual fuel injection capabilities.

DETAILED DESCRIPTION

Figure 1:
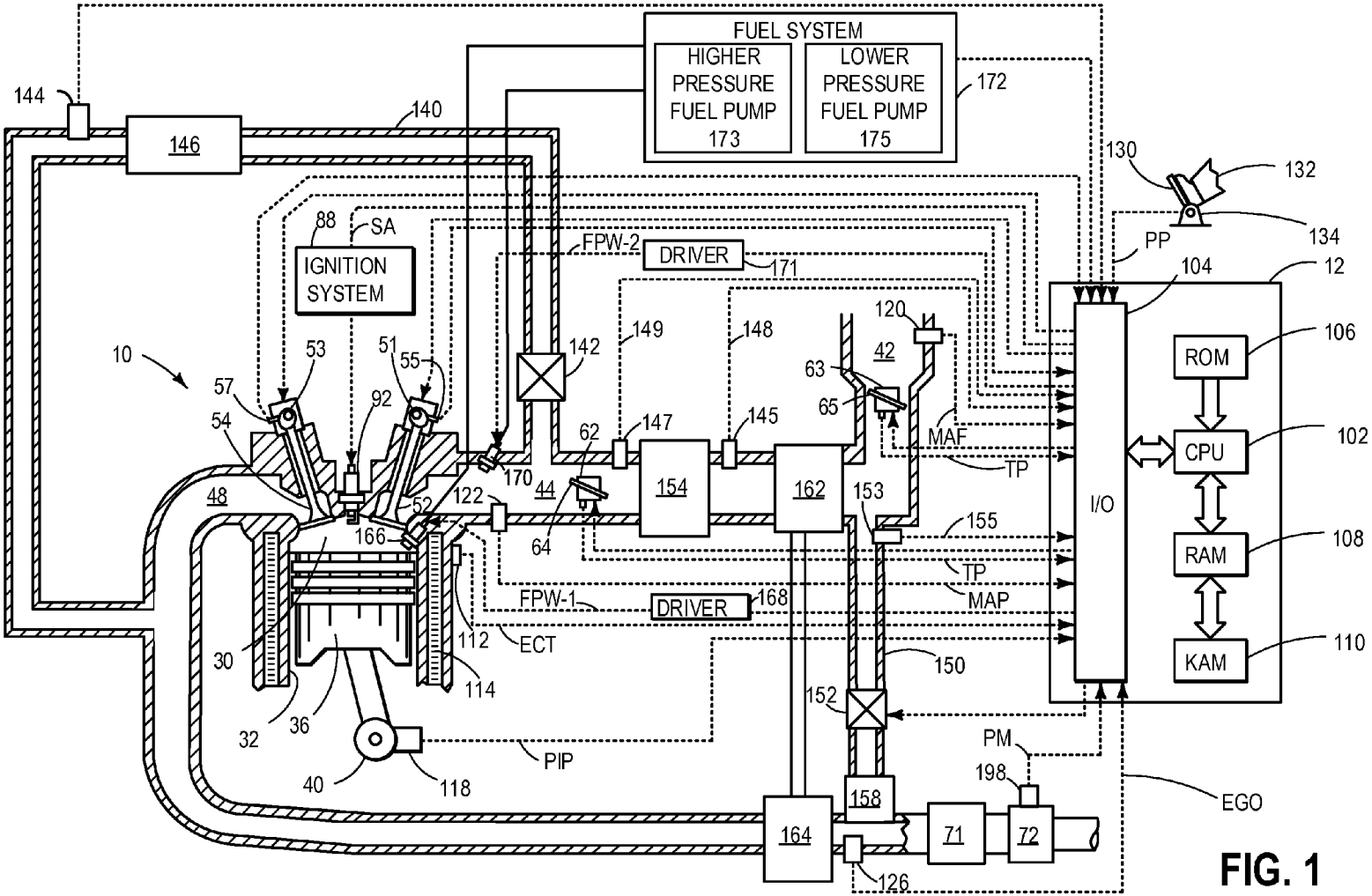
Figure 2:
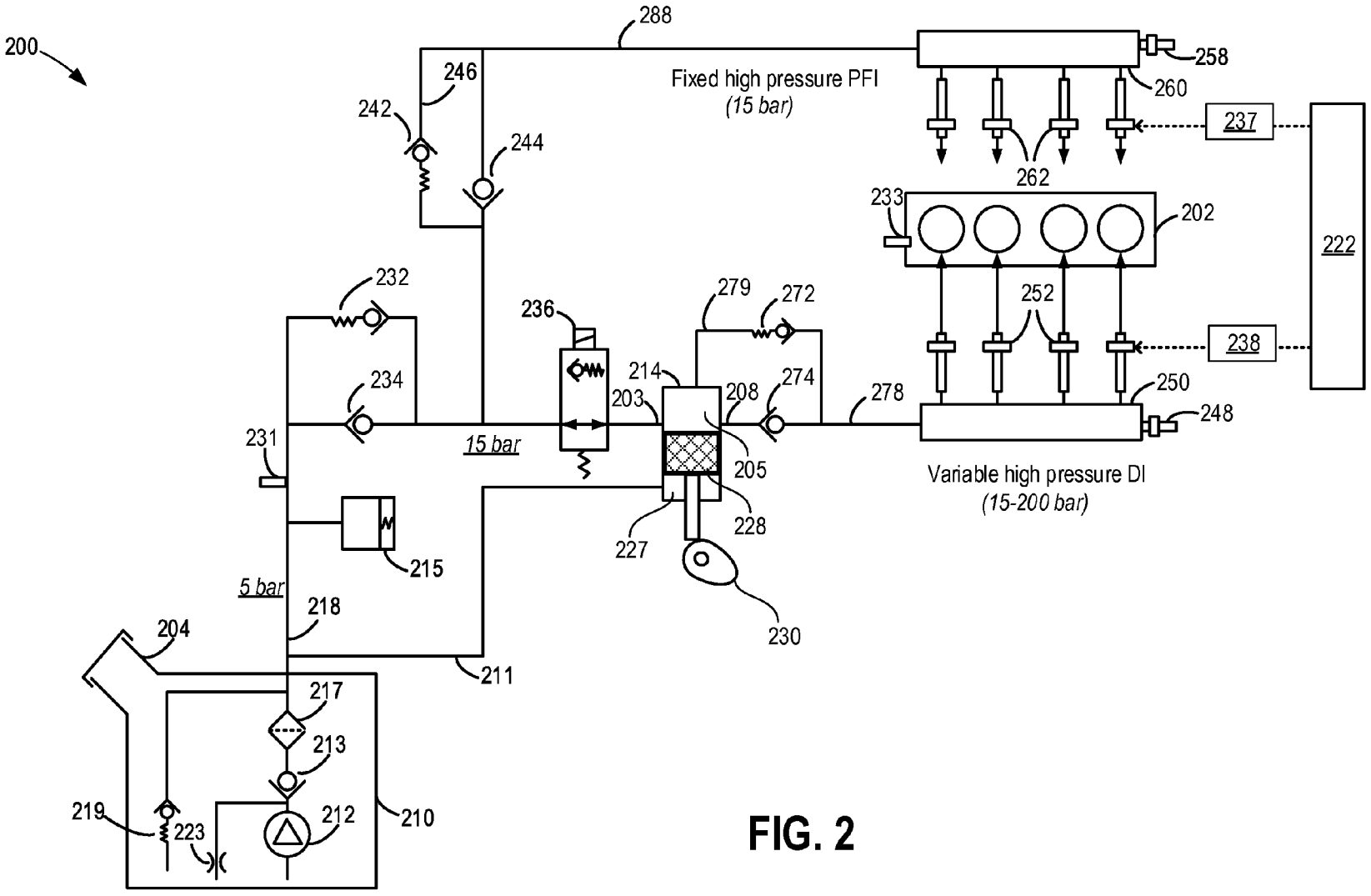
Figure 4:
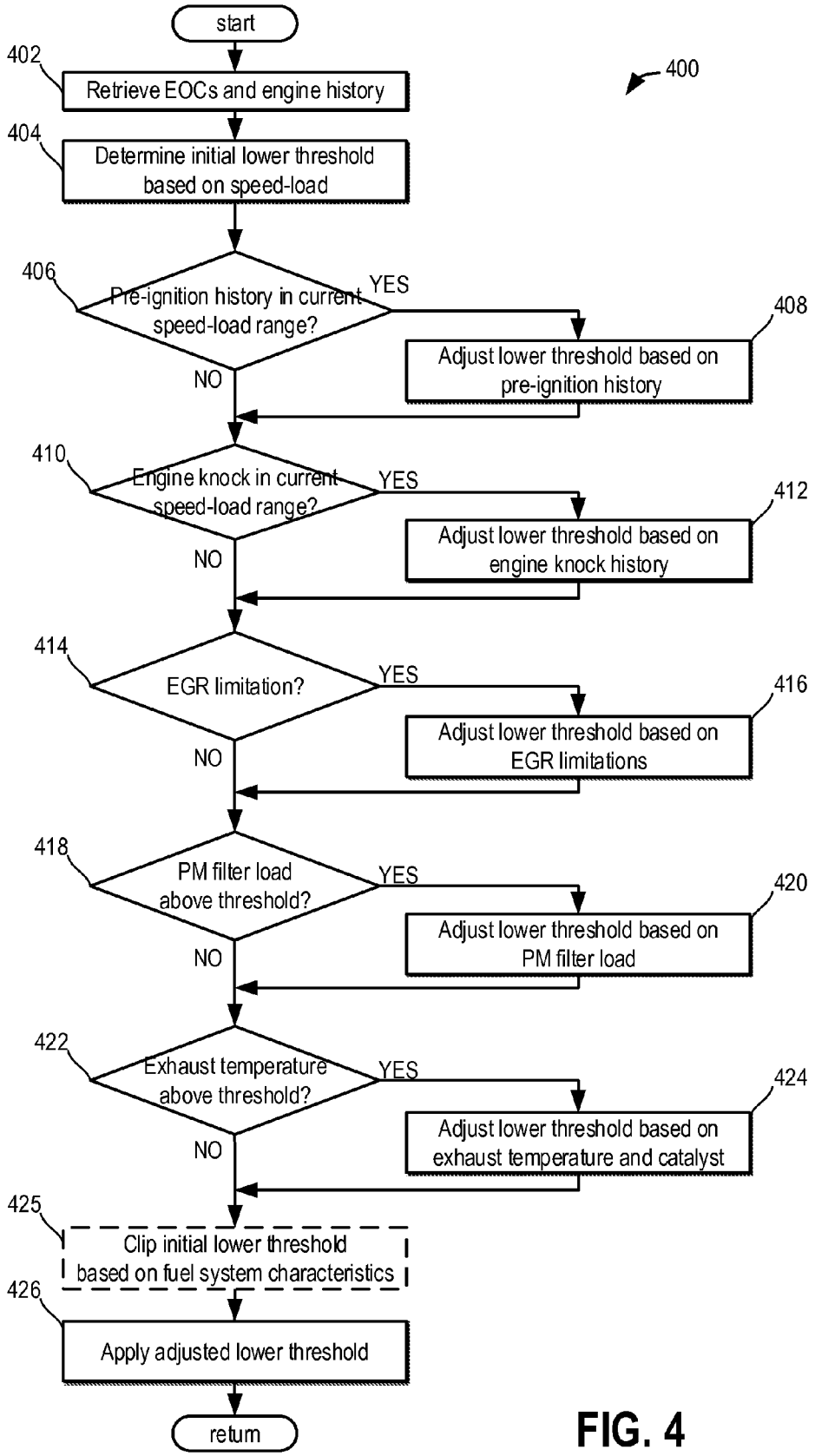
FIG. 4 depicts an example flow chart for adjusting a lower threshold of a fuel rail pressure at which a direct injector is selectively deactivated.
Figure 5:
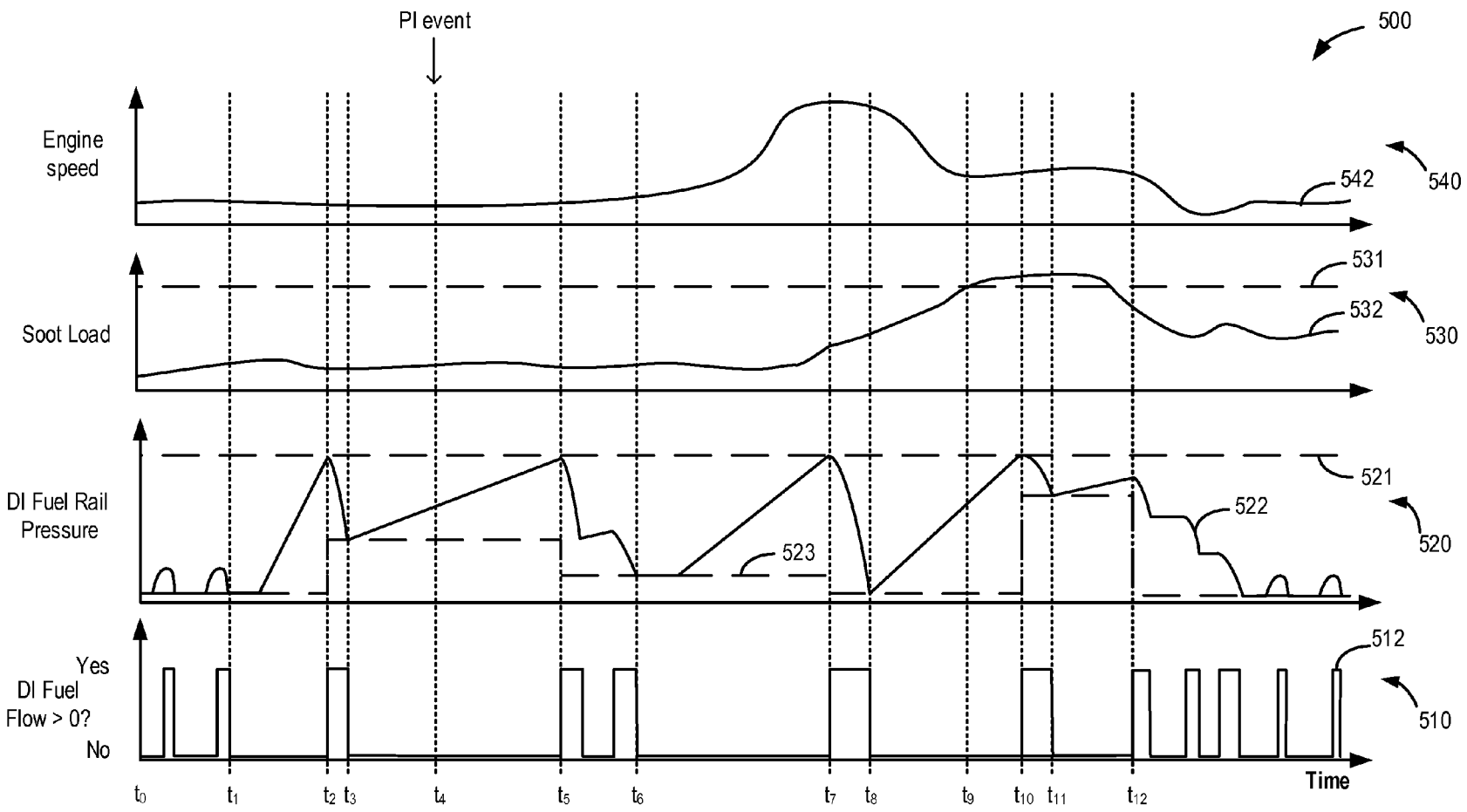
FIG. 5 shows a graphical representation of an example activation and deactivation of a direct-fuel injector while an engine is fueled with port injection, according to the present disclosure.

The present description relates to systems and methods for operating a direct fuel injector within an engine system configured with dual fuel injection capabilities. In one non-limiting example, the engine may be configured as illustrated in FIG. 1. Further, additional components of an associated fuel system is depicted at FIG. 2. An engine controller may be configured to perform a control routine, such as the example routine of FIG. 3 to selectively activate and deactivate the direct fuel injector during conditions when the engine is fueled via port injection only to maintain the direct injection fuel rail pressure within a desired range. Further, the lower threshold at which the direct injector is deactivated may be adjusted, for example in real-time, based on engine operating conditions (FIG. 4). Therein, an initial lower threshold is determined based on an engine speed-load condition, and adjusted based on one or more of pre-ignition history, engine knock history, particulate filter soot load, exhaust temperature, and exhaust gas recirculation limitations. An example timeline for operating a direct fuel injector in accordance with the above methods and systems is depicted in FIG. 5.

Turning now to FIG. 1, it shows a schematic diagram of one cylinder of multi-cylinder engine 10, which may be included in a propulsion system of an automobile. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber (i.e., cylinder) 30 of engine 10 may include combustion chamber walls 32 with piston 36 positioned therein. In some embodiments, the face of piston 36 inside cylinder 30 may have a bowl. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Combustion chamber 30 may receive intake air from intake manifold 44 via intake passage 42 and may exhaust combustion gases via exhaust passage 48. Intake manifold 44 and exhaust passage 48 can selectively communicate with combustion chamber 30 via respective intake valve 52 and exhaust valve 54. In some embodiments, combustion chamber 30 may include two or more intake valves and/or two or more exhaust valves.

Intake valve 52 may be controlled by controller 12 via intake cam 51. Similarly, exhaust valve 54 may be controlled by controller 12 via exhaust cam 53. Alternatively, the variable valve actuator may be electric, electro hydraulic or any other conceivable mechanism to enable valve actuation. During some conditions, controller 12 may vary the signals provided to actuators 51 and 53 to control the opening and closing of the respective intake and exhaust valves. The position of intake valve 52 and exhaust valve 54 may be determined by valve position sensors 55 and 57, respectively. In alternative embodiments, one or more of the intake and exhaust valves may be actuated by one or more cams, and may utilize one or more of cam profile switching (CPS), variable cam timing (VCT), variable valve timing (VVT) and/or variable valve lift (VVL) systems to vary valve operation. For example, cylinder 30 may alternatively include an intake valve controlled via electric valve actuation and an exhaust valve controlled via cam actuation including CPS and/or VCT.

In some embodiments, each cylinder of engine 10 may be configured with one or more fuel injectors for providing fuel thereto. As a non-limiting example, cylinder 30 is shown including two fuel injectors 166 and 170. Fuel injector 166 is shown coupled directly to cylinder 30 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 30. Thus, fuel injector 166 is a direct fuel injector in communication with cylinder 30. While FIG. 1 shows injector 166 as a side injector, it may also be located overhead of the piston, such as near the position of spark plug 92. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from high pressure fuel system 172 including a fuel tank, fuel pumps, a fuel rail, and driver 168. Alternatively, fuel may be delivered by a single stage fuel pump at lower pressure, in which case the timing of the direct fuel injection may be more limited during the compression stroke than if a high pressure fuel system is used. Further, while not shown, the fuel tank may have a pressure transducer providing a signal to controller 12.

Fuel injector 170 is shown arranged in intake passage 42 (e.g., within intake manifold 44), rather than in cylinder 30, in a configuration that provides what is known as port injection of fuel (hereafter referred to as "PFI") into the intake port upstream of cylinder 30. From the intake port, the fuel may be delivered to cylinder 30. Thus, fuel injector 170 is a port fuel injector in communication with cylinder 30. Fuel injector 170 may inject fuel in proportion to the pulse width of signal FPW-2 received from controller 12 via electronic driver 171. Fuel may be delivered to fuel injector 170 by fuel system 172.

Fuel may be delivered by both injectors to the cylinder during a single cycle of the cylinder. For example, each injector may deliver a portion of a total fuel injection that is combusted in cylinder 30. Further, the distribution and/or relative amount of fuel delivered from each injector may vary with operating conditions such as described herein below. The relative distribution of the total injected fuel among injectors 166 and 170 may be referred to as a first injection ratio. For example, injecting a larger amount of the fuel for a combustion event via (port) injector 170 may be an example of a higher first ratio of port to direct injection, while injecting a larger amount of the fuel for a combustion event via (direct) injector 166 may be a lower first ratio of port to direct injection. Note that these are merely examples of different injection ratios, and various other injection ratios may be used. Additionally, it should be appreciated that port injected fuel may be delivered during an open intake valve event, closed intake valve event (e.g., substantially before an intake stroke, such as during an exhaust stroke), as well as during both open and closed intake valve operation. Similarly, directly injected fuel may be delivered during an intake stroke, as well as partly during a previous exhaust stroke, during the intake stroke, and partly during the compression stroke, for example. Further, the direct injected fuel may be delivered as a single injection or multiple injections. These may include multiple injections during the compression stroke, multiple injections during the intake stroke, or a combination of some direct injections during the compression stroke and some during the intake stroke. When multiple direct injections are performed, the relative distribution of the total directed injected fuel between an intake stroke (direct) injection and a compression stroke (direct) injection may be referred to as a second injection ratio. For example, injecting a larger amount of the direct injected fuel for a combustion event during an intake stroke may be an example of a higher second ratio of intake stroke direct injection, while injecting a larger amount of the fuel for a combustion event during a compression stroke may be an example of a lower second ratio of intake stroke direct injection. Note that these are merely examples of different injection ratios, and various other injection ratios may be used.

As such, even for a single combustion event, injected fuel may be injected at different timings from a port and direct injector. Furthermore, for a single combustion event, multiple injections of the delivered fuel may be performed per cycle. The multiple injections may be performed during the compression stroke, intake stroke, or any appropriate combination thereof.

As described above, FIG. 1 shows only one cylinder of a multi-cylinder engine. As such each cylinder may similarly include its own set of intake/exhaust valves, fuel injector(s), spark plug, etc.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Fuel system 172 may include one fuel tank or multiple fuel tanks. In embodiments where fuel system 172 includes multiple fuel tanks, the fuel tanks may hold fuel with the same fuel qualities or may hold fuel with different fuel qualities, such as different fuel compositions. These differences may include different alcohol content, different octane, different heat of vaporizations, different fuel blends, and/or combinations thereof etc. In one example, fuels with different alcohol contents could include gasoline, ethanol, methanol, or alcohol blends such as E85 (which is approximately 85% ethanol and 15% gasoline) or M85 (which is approximately 85% methanol and 15% gasoline). Other alcohol containing fuels could be a mixture of alcohol and water, a mixture of alcohol, water and gasoline etc. In some examples, fuel system 172 may include a fuel tank holding a liquid fuel, such as gasoline, and also include a fuel tank holding a gaseous fuel, such as CNG. Fuel injectors 166 and 170 may be configured to inject fuel from the same fuel tank, from different fuel tanks, from a plurality of the same fuel tanks, or from an overlapping set of fuel tanks. Fuel system 172 may include a lower pressure fuel pump 175 (such as a lift pump) and a higher pressure fuel pump 173. As detailed with reference to the fuel system of FIG. 2, the lower pressure fuel pump 175 may lift fuel from a fuel tank, the fuel then further pressurized by higher pressure fuel pump 173. In addition, lower pressure fuel pump 175 may provide fuel to a port injection fuel rail while higher pressure fuel pump 173 delivers fuel to a direct injection fuel rail.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Intake passage 42 may include throttles 62 and 63 having throttle plates 64 and 65, respectively. In this particular example, the positions of throttle plates 64 and 65 may be varied by controller 12 via signals provided to an electric motor or actuator included with throttles 62 and 63, a configuration that is commonly referred to as electronic throttle control (ETC). In this manner, throttles 62 and 63 may be operated to vary the intake air provided to combustion chamber 30 among other engine cylinders. The positions of throttle plates 64 and 65 may be provided to controller 12 by throttle position signals TP. Pressure, temperature, and mass air flow may be measured at various points along intake passage 42 and intake manifold 44. For example, intake passage 42 may include a mass air flow sensor 120 for measuring clean air mass flow entering through throttle 63. The clean air mass flow may be communicated to controller 12 via the MAF signal.

Engine 10 may further include a compression device such as a turbocharger or supercharger including at least a compressor 162 arranged upstream of intake manifold 44. For a turbocharger, compressor 162 may be at least partially driven by a turbine 164 (e.g., via a shaft) arranged along exhaust passage 48. For a supercharger, compressor 162 may be at least partially driven by the engine and/or an electric machine, and may not include a turbine. Thus, the amount of compression provided to one or more cylinders of the engine via a turbocharger or supercharger may be varied by controller 12. A charge air cooler 154 may be included downstream from compressor 162 and upstream of intake valve 52. Charge air cooler 154 may be configured to cool gases that have been heated by compression via compressor 162, for example. In one embodiment, charge air cooler 154 may be upstream of throttle 62. Pressure, temperature, and mass air flow may be measured downstream of compressor 162, such as with sensor 145 or 147. The measured results may be communicated to controller 12 from sensors 145 and 147 via signals 148 and 149, respectively. Pressure and temperature may be measured upstream of compressor 162, such as with sensor 153, and communicated to controller 12 via signal 155.

Further, in the disclosed embodiments, an exhaust gas recirculation (EGR) system may route a desired portion of exhaust gas from exhaust passage 48 to intake manifold 44. FIG. 1 shows a high pressure EGR (HP-EGR) system and a low pressure EGR (LP-EGR) system, but an alternative embodiment may include only an LP-EGR system. The HP-EGR is routed through HP-EGR passage 140 from upstream of turbine 164 to downstream of compressor 162. The amount of HP-EGR provided to intake manifold 44 may be varied by controller 12 via HP-EGR valve 142. The LP-EGR is routed through LP-EGR passage 150 from downstream of turbine 164 to upstream of compressor 162. The amount of LP-EGR provided to intake manifold 44 may be varied by controller 12 via LP-EGR valve 152. The HP-EGR system may include HP-EGR cooler 146 and the LP-EGR system may include LP-EGR cooler 158 to reject heat from the EGR gases to engine coolant, for example. Thus, engine 10 may comprise both an HP-EGR and an LP-EGR system to route exhaust gases back to the intake.

Under some conditions, the EGR system may be used to regulate the temperature of the air and fuel mixture within combustion chamber 30. Thus, it may be desirable to measure or estimate the EGR mass flow. EGR sensors may be arranged within EGR passages and may provide an indication of one or more of mass flow, pressure, temperature, concentration of $O_2$, and concentration of the exhaust gas. For example, an HP-EGR sensor 144 may be arranged within HP-EGR passage 140.

In some embodiments, one or more sensors may be positioned within LP-EGR passage 150 to provide an indication of one or more of a pressure, temperature, and air-fuel ratio of exhaust gas recirculated through the LP-EGR passage. Exhaust gas diverted through LP-EGR passage 150 may be diluted with fresh intake air at a mixing point located at the junction of LP-EGR passage 150 and intake passage 42. Specifically, by adjusting LP-EGR valve 152 in coordination with first air intake throttle 63 (positioned in the air intake passage of the engine intake, upstream of the compressor), a dilution of the EGR flow may be adjusted.

A percent dilution of the LP-EGR flow may be inferred from the output of a sensor 145 in the engine intake gas stream. Specifically, sensor 145 may be positioned downstream of first intake throttle 63, downstream of LP-EGR valve 152, and upstream of second main intake throttle 62, such that the LP-EGR dilution at or close to the main intake throttle may be accurately determined. Sensor 145 may be, for example, an oxygen sensor such as a UEGO sensor.

Exhaust gas sensor 126 is shown coupled to exhaust passage 48 downstream of turbine 164. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a $NO_x$, HC, or CO sensor.

Emission control devices 71 and 72 are shown arranged along exhaust passage 48 downstream of exhaust gas sensor 126. Devices 71 and 72 may be a selective catalytic reduction (SCR) system, three way catalyst (TWC), $NO_x$ trap, various other emission control devices, or combinations thereof. For example, device 71 may be a TWC and device 72 may be a particulate filter (PF). In some embodiments, PF 72 may be located downstream of TWC 71 (as shown in FIG. 1), while in other embodiments, PF 72 may be positioned upstream of TWC 72 (not shown in FIG. 1). PF 72 may include a soot load sensor 198, which may communicate a particulate matter loading amount via signal PM to controller 12.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Engine speed signal, RPM, may be generated by controller 12 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses every revolution of the crankshaft. The controller 12 receives signals from the various sensors of FIG. 1 (and those of FIG. 2 described below) and employs the various actuators of FIG. 1 (and those of FIG. 2 described below) to adjust engine operation based on the received signals and instructions stored on a memory of the controller.

Storage medium read-only memory 106 can be programmed with computer readable data representing instructions executable by processor 102 for performing the methods described below as well as other variants that are anticipated but not specifically listed. An example routine that may be performed by the controller is described at FIG. 3.

FIG. 2 schematically depicts an example embodiment 200 of a fuel system, such as fuel system 172 of FIG. 1. Fuel system 200 may be operated to deliver fuel to an engine, such as engine 10 of FIG. 1. Fuel system 200 may be operated by a controller to perform some or all of the operations described with reference to the process flows of FIG. 3.

Fuel system 200 includes a fuel storage tank 210 for storing the fuel on-board the vehicle, a lower pressure fuel pump (LPP) 212 (herein also referred to as fuel lift pump 212), and a higher pressure fuel pump (HPP) 214 (herein also referred to as fuel injection pump 214). Fuel may be provided to fuel tank 210 via fuel filling passage 204. In one example, LPP 212 may be an electrically-powered lower pressure fuel pump disposed at least partially within fuel tank 210. LPP 212 may be operated by a controller 222 (e.g., controller 12 of FIG. 1) to provide fuel to HPP 214 via fuel passage 218. LPP 212 can be configured as what may be referred to as a fuel lift pump. As one example, LPP 212 may be a turbine (e.g., centrifugal) pump including an electric (e.g., DC) pump motor, whereby the pressure increase across the pump and/or the volumetric flow rate through the pump may be controlled by varying the electrical power provided to the pump motor, thereby increasing or decreasing the motor speed. For example, as the controller reduces the electrical power that is provided to lift pump 212, the volumetric flow rate and/or pressure increase across the lift pump may be reduced. The volumetric flow rate and/or pressure increase across the pump may be increased by increasing the electrical power that is provided to lift pump 212. As one example, the electrical power supplied to the lower pressure pump motor can be obtained from an alternator or other energy storage device on-board the vehicle (not shown), whereby the control system can control the electrical load that is used to power the lower pressure pump. Thus, by varying the voltage and/or current provided to the lower pressure fuel pump, the flow rate and pressure of the fuel provided at the inlet of the higher pressure fuel pump 214 is adjusted.

LPP 212 may be fluidly coupled to a filter 217, which may remove small impurities contained in the fuel that could potentially damage fuel handling components. A check valve 213, which may facilitate fuel delivery and maintain fuel line pressure, may be positioned fluidly upstream of filter 217. With check valve 213 upstream of the filter 217, the compliance of low-pressure passage 218 may be increased since the filter may be physically large in volume. Furthermore, a pressure relief valve 219 may be employed to limit the fuel pressure in low-pressure passage 218 (e.g., the output from lift pump 212). Relief valve 219 may include a ball and spring mechanism that seats and seals at a specified pressure differential, for example. The pressure differential set-point at which relief valve 219 may be configured to open may assume various suitable values; as a non-limiting example the set-point may be 6.4 bar or 5 bar (g). An orifice 223 may be utilized to allow for air and/or fuel vapor to bleed out of the lift pump 212. This bleed at 223 may also be used to power a jet pump used to transfer fuel from one location to another within the tank 210. In one example, an orifice check valve (not shown) may be placed in series with orifice 223. In some embodiments, fuel system 8 may include one or more (e.g., a series) of check valves fluidly coupled to low-pressure fuel pump 212 to impede fuel from leaking back upstream of the valves. In this context, upstream flow refers to fuel flow traveling from fuel rails 250, 260 towards LPP 212 while downstream flow refers to the nominal fuel flow direction from the LPP towards the HPP 214 and thereon to the fuel rails.

Fuel lifted by LPP 212 may be supplied at a lower pressure into a fuel passage 218 leading to an inlet 203 of HPP 214. HPP 214 may then deliver fuel into a first fuel rail 250 coupled to one or more fuel injectors of a first group of direct injectors 252 (herein also referred to as a first injector group). Thus fuel rail 250 is in communication with a direct injector. Fuel lifted by the LPP 212 may also be supplied to a second fuel rail 260 coupled to one or more fuel injectors of a second group of port injectors 262 (herein also referred to as a second injector group). Thus fuel rail 260 is in communication with a port injector. As elaborated below, HPP 214 may be operated to raise the pressure of fuel delivered to each of the first and second fuel rail above the lift pump pressure, with the first fuel rail coupled to the direct injector group operating with a variable high pressure while the second fuel rail coupled to the port injector group operates with a fixed high pressure. Thus, high-pressure fuel pump 214 is in communication with each of fuel rail 260 and fuel rail 250. As a result, high pressure port and direct injection may be enabled. The high pressure fuel pump is coupled downstream of the low pressure lift pump with no additional pump positioned in between the high pressure fuel pump and the low pressure lift pump.

While each of first fuel rail 250 and second fuel rail 260 are shown dispensing fuel to four fuel injectors of the respective injector group 252, 262, it will be appreciated that each fuel rail 250, 260 may dispense fuel to any suitable number of fuel injectors. As one example, first fuel rail 250 may dispense fuel to one fuel injector of first injector group 252 for each cylinder of the engine while second fuel rail 260 may dispense fuel to one fuel injector of second injector group 262 for each cylinder of the engine. Controller 222 can individually actuate each of the port injectors 262 via a port injection driver 237 and actuate each of the direct injectors 252 via a direct injection driver 238. The controller 222, the drivers 237, 238 and other suitable engine system controllers can comprise a control system. While the drivers 237, 238 are shown external to the controller 222, it should be appreciated that in other examples, the controller 222 can include the drivers 237, 238 or can be configured to provide the functionality of the drivers 237, 238. Controller 222 may include additional components not shown, such as those included in controller 12 of FIG. 1.

HPP 214 may be an engine-driven, positive-displacement pump. As one non-limiting example, HPP 214 may be a BOSCH HDP5 HIGH PRESSURE PUMP, which utilizes a solenoid activated control valve (e.g., fuel volume regulator, magnetic solenoid valve, etc.) 236 to vary the effective pump volume of each pump stroke. The outlet check valve of HPP is mechanically controlled and not electronically controlled by an external controller. HPP 214 may be mechanically driven by the engine in contrast to the motor driven LPP 212. HPP 214 includes a pump piston 228, a pump compression chamber 205 (herein also referred to as compression chamber), and a step-room 227. Pump piston 228 receives a mechanical input from the engine crank shaft or cam shaft via cam 230, thereby operating the HPP according to the principle of a cam-driven single-cylinder pump. A sensor (not shown in FIG. 2) may be positioned near cam 230 to enable determination of the angular position of the cam (e.g., between 0 and 360 degrees), which may be relayed to controller 222.

Fuel system 200 may optionally further include accumulator 215. When included, accumulator 215 may be positioned downstream of lower pressure fuel pump 212 and upstream of higher pressure fuel pump 214, and may be configured to hold a volume of fuel that reduces the rate of fuel pressure increase or decrease between fuel pumps 212 and 214. For example, accumulator 215 may be coupled in fuel passage 218, as shown, or in a bypass passage 211 coupling fuel passage 218 to the step-room 227 of HPP 214. The volume of accumulator 215 may be sized such that the engine can operate at idle conditions for a predetermined period of time between operating intervals of lower pressure fuel pump 212. For example, accumulator 215 can be sized such that when the engine idles, it takes one or more minutes to deplete pressure in the accumulator to a level at which higher pressure fuel pump 214 is incapable of maintaining a sufficiently high fuel pressure for fuel injectors 252, 262. Accumulator 215 may thus enable an intermittent operation mode (or pulsed mode) of lower pressure fuel pump 212. By reducing the frequency of LPP operation, power consumption is reduced. In other embodiments, accumulator 215 may inherently exist in the compliance of fuel filter 217 and fuel passage 218, and thus may not exist as a distinct element.

A lift pump fuel pressure sensor 231 may be positioned along fuel passage 218 between lift pump 212 and higher pressure fuel pump 214. In this configuration, readings from sensor 231 may be interpreted as indications of the fuel pressure of lift pump 212 (e.g., the outlet fuel pressure of the lift pump) and/or of the inlet pressure of higher pressure fuel pump. Readings from sensor 231 may be used to assess the operation of various components in fuel system 200, to determine whether sufficient fuel pressure is provided to higher pressure fuel pump 214 so that the higher pressure fuel pump ingests liquid fuel and not fuel vapor, and/or to minimize the average electrical power supplied to lift pump 212. While lift pump fuel pressure sensor 231 is shown as being positioned downstream of accumulator 215, in other embodiments the sensor may be positioned upstream of the accumulator.

First fuel rail 250 includes a first fuel rail pressure sensor 248 for providing an indication of direct injection fuel rail pressure to the controller 222. Likewise, second fuel rail 260 includes a second fuel rail pressure sensor 258 for providing an indication of port injection fuel rail pressure to the controller 222. An engine speed sensor 233 can be used to provide an indication of engine speed to the controller 222. The indication of engine speed can be used to identify the speed of higher pressure fuel pump 214, since the pump 214 is mechanically driven by the engine 202, for example, via the crankshaft or camshaft.

First fuel rail 250 is coupled to an outlet 208 of HPP 214 along fuel passage 278. In comparison, second fuel rail 260 is coupled to an inlet 203 of HPP 214 via fuel passage 288. A check valve and a pressure relief valve may be positioned between the outlet 208 of the HPP 214 and the first fuel rail. In addition, pressure relief valve 272, arranged parallel to check valve 274 in bypass passage 279, may limit the pressure in fuel passage 278, located downstream of HPP 214 and upstream of first fuel rail 250. For example, pressure relief valve 272 may limit the pressure in fuel passage 278 to an upper threshold pressure (e.g., 200 bar). As such, pressure relief valve 272 may limit the pressure that would otherwise be generated in fuel passage 278 if control valve 236 were (intentionally or unintentionally) open and while high pressure fuel pump 214 were pumping.

One or more check valves and pressure relief valves may also be coupled to fuel passage 218, downstream of LPP 212 and upstream of HPP 214. For example, check valve 234 may be provided in fuel passage 218 to reduce or prevent back-flow of fuel from high pressure pump 214 to low pressure pump 212 and fuel tank 210. In addition, pressure relief valve 232 may be provided in a bypass passage, positioned parallel to check valve 234. Pressure relief valve 232 may limit the pressure to its left to 10 bar higher than the pressure at sensor 231.

Controller 222 may be configured to regulate fuel flow into HPP 214 through control valve 236 by energizing or de-energizing the solenoid valve (based on the solenoid valve configuration) in synchronism with the driving cam. Accordingly, the solenoid activated control valve 236 may be operated in a first mode where the valve 236 is positioned within HPP inlet 203 to limit (e.g., inhibit) the amount of fuel traveling through the solenoid activated control valve 236. Depending on the timing of the solenoid valve actuation, the volume transferred to the fuel rail 250 is varied. The solenoid valve may also be operated in a second mode where the solenoid activated control valve 236 is effectively disabled and fuel can travel upstream and downstream of the valve, and in and out of HPP 214.

As such, solenoid activated control valve 236 may be configured to regulate the mass (or volume) of fuel compressed into the direct injection fuel pump. In one example, controller 222 may adjust a closing timing of the solenoid pressure control check valve to regulate the mass of fuel compressed. For example, a late pressure control valve closing may reduce the amount of fuel mass ingested into compression chamber 205. The solenoid activated check valve opening and closing timings may be coordinated with respect to stroke timings of the direct injection fuel pump.

Pressure relief valve 232 allows fuel flow out of solenoid activated control valve 236 toward the LPP 212 when pressure between pressure relief valve 232 and solenoid operated control valve 236 is greater than a predetermined pressure (e.g., 10 bar). When solenoid operated control valve 236 is deactivated (e.g., not electrically energized), solenoid operated control valve operates in a pass-through mode and pressure relief valve 232 regulates pressure in compression chamber 205 to the single pressure relief set-point of pressure relief valve 232 (e.g., 10 bar above the pressure at sensor 231). Regulating the pressure in compression chamber 205 allows a pressure differential to form from the piston top to the piston bottom. The pressure in step-room 227 is at the pressure of the outlet of the low pressure pump (e.g., 5 bar) while the pressure at piston top is at pressure relief valve regulation pressure (e.g., 15 bar). The pressure differential allows fuel to seep from the piston top to the piston bottom through the clearance between the piston and the pump cylinder wall, thereby lubricating HPP 214.

Piston 228 reciprocates up and down. HPP 214 is in a compression stroke when piston 228 is traveling in a direction that reduces the volume of compression chamber 205. HPP 214 is in a suction stroke when piston 228 is traveling in a direction that increases the volume of compression chamber 205.

A forward flow outlet check valve 274 may be coupled downstream of an outlet 208 of the compression chamber 205. Outlet check valve 274 opens to allow fuel to flow from the high pressure pump outlet 208 into a fuel rail only when a pressure at the outlet of direct injection fuel pump 214 (e.g., a compression chamber outlet pressure) is higher than the fuel rail pressure. Thus, during conditions when direct injection fuel pump operation is not requested, controller 222 may deactivate solenoid activated control valve 236 and pressure relief valve 232 regulates pressure in compression chamber 205 to a single substantially constant pressure during most of the compression stroke. On the intake stroke the pressure in compression chamber 205 drops to a pressure near the pressure of the lift pump (212). Lubrication of DI pump 214 may occur when the pressure in compression chamber 205 exceeds the pressure in step-room 227. This difference in pressures may also contribute to pump lubrication when controller 222 deactivates solenoid activated control valve 236. One result of this regulation method is that the fuel rail is regulated to a minimum pressure, approximately the pressure relief of pressure relief valve 232. Thus, if pressure relief valve 232 has a pressure relief setting of 10 bar, the fuel rail pressure becomes 15 bar because this 10 bar adds to the 5 bar of lift pump pressure. Specifically, the fuel pressure in compression chamber 205 is regulated during the compression stroke of direct injection fuel pump 214. Thus, during at least the compression stroke of direct injection fuel pump 214, lubrication is provided to the pump. When direct fuel injection pump enters a suction stroke, fuel pressure in the compression chamber may be reduced while still some level of lubrication may be provided as long as the pressure differential remains. Another pressure relief valve 272 may be placed in parallel with check valve 274. Pressure relief valve 272 allows fuel flow out of the DI fuel rail 250 toward pump outlet 208 when the fuel rail pressure is greater than a predetermined upper threshold pressure. As such, while the direct injection fuel pump is reciprocating, the flow of fuel between the piston and bore ensures sufficient pump lubrication and cooling.

The lift pump may be transiently operated in a pulsed mode where the lift pump operation is adjusted based on a pressure estimated at the outlet of the lift pump and inlet of the high pressure pump. In particular, responsive to high pressure pump inlet pressure falling below a fuel vapor pressure, the lift pump may be operated until the inlet pressure is at or above the fuel vapor pressure. This reduces the risk of the high pressure fuel pump ingesting fuel vapors (instead of fuel) and ensuing engine stall events.

It is noted here that the high pressure pump 214 of FIG. 2 is presented as an illustrative example of one possible configuration for a high pressure pump. Components shown in FIG. 2 may be removed and/or changed while additional components not presently shown may be added to pump 214 while still maintaining the ability to deliver high-pressure fuel to a direct injection fuel rail and a port injection fuel rail.

Solenoid activated control valve 236 may also be operated to direct fuel back-flow from the high pressure pump to one of pressure relief valve 232 and accumulator 215. For example, control valve 236 may be operated to generate and store fuel pressure in accumulator 215 for later use. One use of accumulator 215 is to absorb fuel volume flow that results from the opening of compression pressure relief valve 232. Accumulator 227 sources fuel as check valve 234 opens during the intake stroke of pump 214. Another use of accumulator 215 is to absorb/source the volume changes in the step room 227. Yet another use of accumulator 215 is to allow intermittent operation of lift pump 212 to gain an average pump input power reduction over continuous operation.

While the first direct injection fuel rail 250 is coupled to the outlet 208 of HPP 214 (and not to the inlet of HPP 214), second port injection fuel rail 260 is coupled to the inlet 203 of HPP 214 (and not to the outlet of HPP 214). Although inlets, outlets, and the like relative to compression chamber 205 are described herein, it may be appreciated that there may be a single conduit into compression chamber 205. The single conduit may serve as inlet and outlet. In particular, second fuel rail 260 is coupled to HPP inlet 203 at a location upstream of solenoid activated control valve 236 and downstream of check valve 234 and pressure relief valve 232. Further, no additional pump may be required between lift pump 212 and the port injection fuel rail 260. As elaborated below, the specific configuration of the fuel system with the port injection fuel rail coupled to the inlet of the high pressure pump via a pressure relief valve and a check valve enables the pressure at the second fuel rail to be raised via the high pressure pump to a fixed default pressure that is above the default pressure of the lift pump. That is, the fixed high pressure at the port injection fuel rail is derived from the high pressure piston pump.

When the high pressure pump 214 is not reciprocating, such as at key-up before cranking, check valve 244 allows the second fuel rail to fill at 5 bar. As the pump chamber displacement becomes smaller due to the piston moving upward, the fuel flows in one of two directions. If the spill valve 236 is closed, the fuel goes into the high pressure fuel rail 250 via high pressure fuel pump outlet 208. If the spill valve 236 is open, the fuel goes either into the low pressure fuel rail 250 or through the compression relief valve 232 via high pressure fuel pump inlet 203. In this way, the high pressure fuel pump is operated to deliver fuel at a variable high pressure (such as between 15-200 bar) to the direct fuel injectors 252 via the first fuel rail 250 while also delivering fuel at a fixed high pressure (such as at 15 bar) to the port fuel injectors 262 via the second fuel rail 260. The variable pressure may include a minimum pressure that is at the fixed pressure (as in the system of FIG. 2).

Thus spill valve 236 may be operated to control a bulk fuel flow from the high pressure fuel pump outlet to DI fuel rail 250 to be substantially equal to zero, and to control a bulk fuel flow from the high pressure fuel pump inlet to PFI fuel rail 260. As one example, when one or more direct injectors 252 are deactivated, spill valve 236 may be operated to control the bulk fuel flow from HPP outlet 208 to DI fuel rail 250 to be substantially equal to zero. Additionally, the bulk fuel flow from HPP outlet 208 to DI fuel rail 250 may be controlled to be substantially equal to zero if direct injectors 252 are activated while pressure within DI fuel rail 250 is above a minimum pressure threshold (e.g., 15 bar). In both conditions, bulk fuel flow form HPP inlet 203 to PFI fuel rail 260 may be controlled to be substantially greater than zero. When fuel flow to one of fuel rails 250 or 260 is controlled to be substantially equal to zero, fuel flow thereto may be herein be referred to as disabled.

In the configuration depicted at FIG. 2, the fixed pressure of the port injection fuel rail is the same as the minimum pressure for the direct injection fuel rail, both being higher than the default pressure of the lift pump. Herein, the fuel delivery from the high pressure pump is controlled via the upstream (solenoid activated) control valve and further via the various check valve and pressure relief valves coupled to the inlet of the high pressure pump. By adjusting operation of the solenoid activated control valve, the fuel pressure at the first fuel rail is raised from the fixed pressure to the variable pressure while maintaining the fixed pressure at the second fuel rail. Valves 244 and 242 work in conjunction to keep the low pressure fuel rail 260 pressurized to 15 bar during the pump inlet stroke. Pressure relief valve 242 simply limits the pressure that can build in fuel rail 250 due to thermal expansion of fuel. A typical pressure relief setting may be 20 bar.

Controller 222 can also control the operation of each of fuel pumps 212, and 214 to adjust an amount, pressure, flow rate, etc., of a fuel delivered to the engine. As one example, controller 12 can vary a pressure setting, a pump stroke amount, a pump duty cycle command, and/or fuel flow rate of the fuel pumps to deliver fuel to different locations of the fuel system. A driver (not shown) electronically coupled to controller 222 may be used to send a control signal to the low pressure pump, as required, to adjust the output (e.g., speed) of the low pressure pump. In some examples, the solenoid valve may be configured such that high pressure fuel pump 214 delivers fuel only to first fuel rail 250, and in such a configuration, second fuel rail 260 may be supplied fuel at the lower outlet pressure of lift pump 212.

Controller 222 can control the operation of each of injector groups 252 and 262. For example, controller 222 may control the distribution and/or relative amount of fuel delivered from each injector may vary with operating conditions, such as engine load, knock, and exhaust temperature. Specifically, controller 222 may adjust a direct injection fuel ratio by sending appropriate signals to port fuel injection driver 237 and direct injection 238, which may in turn actuate the respective port fuel injectors 262 and direct injectors 252 with desired pulse-widths for achieving the desired injection ratios. Additionally, controller 222 may selectively enable and disable (i.e., activate or deactivate) one or more of the injector groups based on fuel pressure within each rail. For example, based on a signal from first fuel rail pressure sensor 248, controller 222 may selectively activate second injector group 262 while controlling first injector group 252 in a deactivated state via respective injector drivers 237 and 238.

During some conditions, fuel pressure downstream of high pressure fuel pump 214 (e.g., within first fuel rail 250) may increase to an upper threshold pressure while fuel injectors 252 are deactivated. As one example, the fuel injectors may be operated to inject via only PFI (e.g., via injectors 262) based on engine operating conditions, and thus fuel injectors 252 may be deactivated during this time. While delivering fuel to the engine via only PFI, an increase in fuel rail temperature may result in an increase in DI fuel rail pressure to the upper threshold pressure, and check valve 272 may maintain DI fuel rail 250 at the upper threshold pressure. However, maintaining the DI fuel rail at the upper threshold for an extended duration may result in direct injector degradation and/or DI fuel rail degradation. Thus, during conditions wherein DI fuel rail pressure is sustained at the upper threshold pressure, it may be desirable to reduce DI fuel rail pressure to a lower threshold amount via direct injection. However, direct injection may not be desirable during conditions wherein fuel is injected via only PFI. As a result, the lower pressure threshold for the DI fuel rail may need to be adjusted based on a number of engine operating conditions, thereby adjusting the amount of fuel delivered via DI based on each of a DI fuel rail pressure and engine operating conditions.

Figure 3:
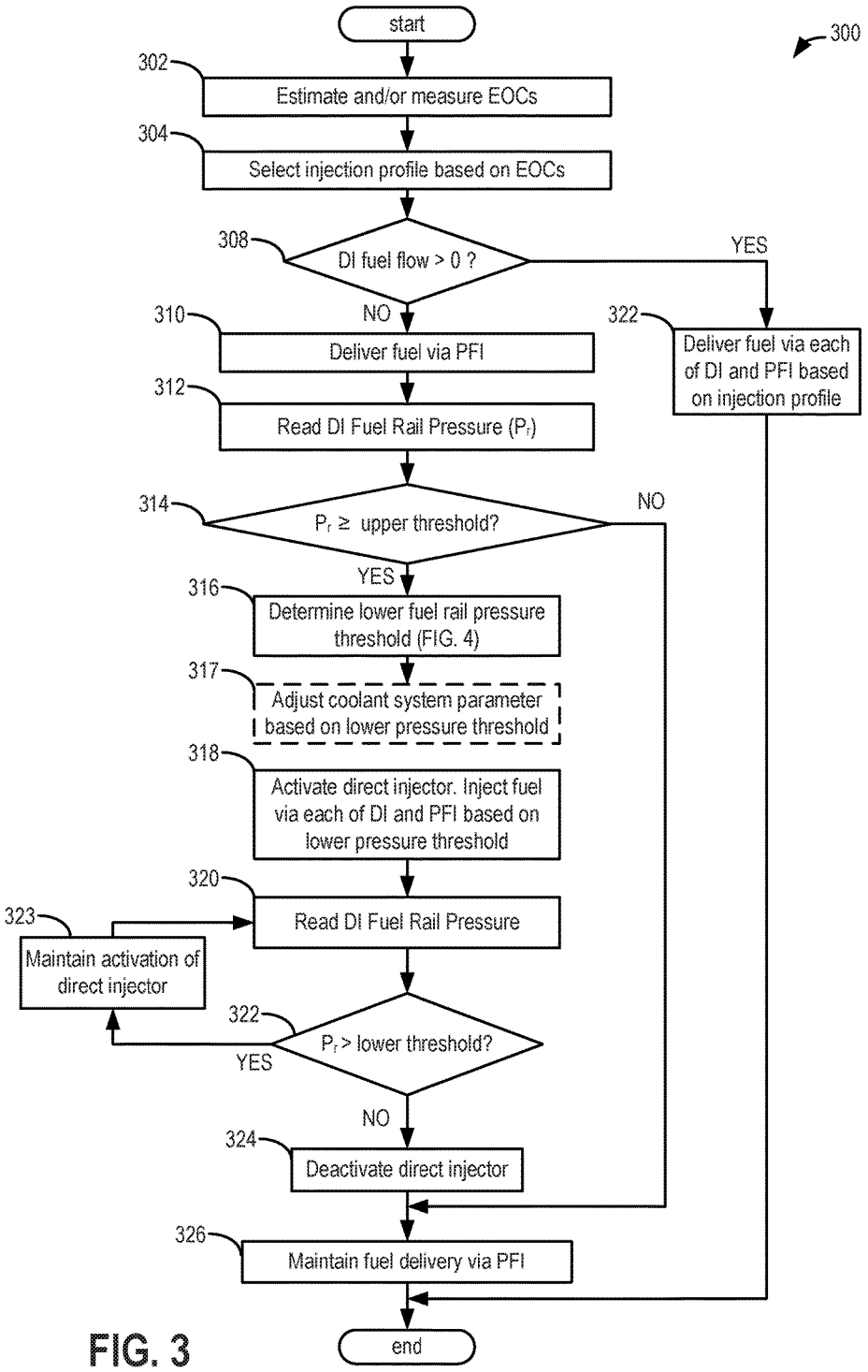
FIG. 3 depicts an example high level flow chart for operating an internal combustion engine including a port-fuel injection system and a direct-fuel injection system according to the present disclosure.

FIG. 3 shows an example method 300 for operating internal combustion engine 10 and fuel system 200 as respectively depicted in FIGS. 1 and 2. Method 300 may be configured as computer instructions stored by a control system and implemented by a controller, for example controller 12 as shown at FIGS. 1-2. In particular, method 300 may include instructions for operating each of the port injectors and direct injectors during conditions in which a DI fuel rail pressure has reached an upper threshold pressure. Instructions for carrying out method 300 and the rest of the methods included herein may be executed by a controller based on instructions stored on a memory of the controller and in conjunction with signals received from sensors of the engine system, such as the sensors described above with reference to FIGS. 1-2. The controller may employ engine actuators of the engine system to adjust engine operation, according to the methods described below.

At 302, method 300 may begin by measuring and/or estimating engine (and vehicle) operating conditions (EOCs). Estimating and/or measuring vehicle and engine operating conditions may include, for example, estimating and/or measuring engine temperature, ambient conditions (ambient temperature, pressure, humidity, etc.), torque demand, manifold pressure, manifold air flow, exhaust temperature, particulate filter load, canister load, exhaust catalyst conditions, oil temperature, oil pressure, soak time, a position of a fuel pipe of the fuel system, etc. Estimating and/or measuring vehicle and engine operating conditions may include receiving signals from a plurality of sensors, such as the sensors at FIGS. 1-2, and processing these signals in an appropriate manner at an engine controller (e.g., controller 12 at FIG. 1).

At 304, method 300 may include selecting a fuel injection profile based on the engine operating conditions determined at 302. For example, the fuel injection profile may include details regarding an amount of fuel to be delivered, a timing of fuel injection, a number of injections for a given cylinder combustion event, as well as a ratio of fuel to be delivered via port relative to direct injection. The fuel injection profile may include, for example, instructions to deliver fuel to the engine according to each of a first injection ratio and a second injection ratio, as described with regard to FIG. 1. It will be appreciated that in some examples, if an injection profile indicates delivering fuel via only port fuel injection (PFI), the direct injectors of the fuel system may be deactivated while the port injectors are maintained activated. Similarly, if an injection profile includes instructions to deliver fuel via only direct injection (DI), the port injectors of the fuel system may be deactivated while the direct injectors are maintained activated.

Continuing now to 308, it may be determined whether the fuel injection profile selected at 304 includes a DI fuel flow (or fuel mass) greater than 0. That is to say, it may be determined whether the fuel injection profile includes delivering at least some fuel via direct injection. If it is determined that DI fuel flow is greater than zero, routine 300 proceeds to 322, where fuel is delivered via each of direct injection and port injection according to the injection profile determined at 304. After 322, routine 300 terminates.

Otherwise, if it is determined that DI fuel flow is zero, routine 300 proceeds to 310, where fuel is delivered to the engine via only PFI according to the selected fuel injection profile. Put another way, 310 includes operating an engine cylinder with fuel from only a first (e.g., port) injector. While fuel is delivered to the engine via only port fuel injection, the direct injectors may be deactivated. As a result, fuel may be stagnating in the high pressure direct injection fuel rail. Consequently, the fuel pressure within the DI fuel rail may be subject to pressure variations (e.g., increase) as a result of temperature fluctuations (e.g., increase) within the DI fuel rail.

At 312, method 300 may include reading the pressure of the direct injection fuel rail. For example, with reference to FIG. 2, controller 222 may assess the fuel pressure in fuel rail 250 via a signal received from pressure sensor 248. Herein, the fuel pressure within the direct injection fuel rail will be referred to as $P_r$.

Proceeding to 314, $P_r$ may be compared to an upper threshold pressure. Specifically, routine 300 determines whether $P_r$ is greater than or equal to the upper threshold pressure. It will be appreciated that determining whether $P_r$ is greater than or equal to the upper threshold pressure may include determining whether $P_r$ has been sustained at or above the upper threshold pressure for at least a threshold duration. The upper threshold pressure may be a pressure above which high pressure fuel pump degradation and/or direct fuel injector degradation can occur. As one example, with reference to fuel system 200, the upper threshold pressure may be the threshold pressure at which check valve 272 allows fuel to flow from fuel passage 278 to a location upstream of HPP 214. As another example, the upper threshold pressure may be based on a fuel injector control parameter, such as a threshold pressure above which injection mass commands have been determined to be less reliable (e.g., a learned threshold determined empirically during an injection calibration routine). As a still further example, the upper threshold pressure may be based on each of fuel rigidity and a coefficient of thermal expansion of the fuel rail. As yet another example, the upper threshold pressure may be based on a minimum injection pulse-width, which may correspond to a minimum desired injection mass at the upper threshold pressure.

If $P_r$ is determined to be less than the upper threshold pressure at 314, it may be undesirable to reduce the pressure within the direct injection fuel rail (e.g., to maintain the benefits of delivering fuel via only PFI according to the fuel injection profile), and routine 300 proceeds directly to 326 to maintain fuel delivery via only the port fuel injection system and maintain the direct injectors selectively deactivated. Otherwise, if $P_r$ is greater than or equal to the upper threshold pressure at 314, routine 300 proceeds to 316 to determine a lower pressure threshold to which the direct injection fuel rail pressure may be reduced, as described in further detail below with reference to FIG. 4. As described therein, the lower threshold may be adjusted, for example in real-time, based on engine limitations, such as particulate matter limitations, abnormal combustion event limitations, EGR limitation, etc.

After determining a lower pressure threshold at 316, routine 300 may, in some examples, proceed to 317. In other examples, routine 300 may proceed directly to 318. At 317, routine 300 may include the optional step of adjusting a parameter of coolant flow in response to the rail pressure increase of the fuel rail. The parameter of coolant flow may be one or more of the flow rate of coolant, the temperature of coolant, the source of coolant, etc. When coolant flow has been adjusted, method 300 may proceed to 318 to activate a direct injector.

At 318, a cylinder direct injector may be activated to enable cylinder direct injection of fuel. Put another way, in response to the direct injector fuel rail pressure increase (e.g., increasing above the upper threshold) at 314, routine 300 may transiently activate a second (e.g., direct) injector to inject fuel into the cylinder at 318. It will be appreciated that activating the direct injector includes maintaining delivery of at least some fuel to the engine via PFI. In addition, activating the direct injector may include adjusting injection of fuel from the port injector responsive to fuel injected by the direct injector. The ratio of direct injection fuel mass to port injection fuel mass for each cylinder combustion event may be determined based on one or more of the lower fuel rail pressure threshold, engine speed, engine load, engine temperature, exhaust temperature, soot load, spark timing, valve timing, etc. It will be further appreciated that injecting the predetermined fuel injection mass may occur across a number of injection events to maintain a desired air-fuel ratio, etc. Additionally, activating the direct injector at 318 may include not delivering fuel to the direct injection fuel rail via the high pressure fuel pump. In this way, pressurization of the DI fuel rail via the high pressure fuel pump may be avoided while reducing the DI fuel pressure via direct injection.

In the depicted example, as described below with reference to 318, 320, 322, 323, and 324, activating the direct injectors includes injecting an amount of fuel via the direct injectors, monitoring the fuel rail pressure, and continuing direct injection until the fuel rail pressure is equal to the lower threshold pressure. However, it will be appreciated that in other examples, monitoring of fuel rail pressure may not be included in the activating of the direct injector. As an example, activating the direct injector may include executing one or more open loop direct injection commands based on the lower threshold pressure, engine speed, engine load, and total injection mass commands (e.g., the amount to be delivered across each of PFI and DI). Put another way, activating the direct injector may include activating the direct injector for a predetermined amount of time, or controlling the direct injector to pump a predetermined amount of fuel therethrough.

In a still further example, the direct injectors may be activated and a parameter associated with a different engine operating condition (e.g., soot load) may be monitored. In this example, if the engine operating parameter exceeds a specified threshold value before the lower fuel rail threshold pressure is reached, direct injection may be deactivated. In this way, a desired engine performance may be maintained while reducing the amount of pressure within the DI fuel rail. Additionally in this still further example, an engine parameter map such as that referenced at FIG. 4 may be adjusted based on the deactivation of the direct injectors. Specifically, the lower fuel rail pressure threshold associated with the specified threshold value of the engine operating parameter may be adjusted to a greater value if the engine operating parameter exceeds the threshold before the lower pressure threshold is reached. In this way, errors in determining future lower DI fuel rail pressure thresholds may be reduced.

At 320, method 300 may include measuring $P_r$. After measuring $P_r$, routine 300 proceeds to 322 to determine whether $P_r$ is below the lower pressure threshold determined at 316.

If, at 322, $P_r$ is greater than the lower threshold value, method 300 proceeds to 323, where the activation of the direct injector is maintained. As one example, maintaining activation of the direct injector may include maintaining the direct injector in an open position (e.g., continuing a present injection event). As another example, maintaining activation of the direct injector may include injecting fuel via the direct injector across one or more additional combustion events. After 323, routine 300 returns to 320 to again measure $P_r$.

Instead, if $P_r$ is less than the lower threshold value, routine 300 proceeds to 324, where direct injectors may be deactivated. Put another way, routine 300 includes deactivating the direct injector in response to a fuel pressure decrease at the DI fuel rail below a lower threshold (e.g., as determined at 316), the lower threshold adjusted based on one or more engine operating conditions (e.g., adjusted via routine 400). Additionally, in a similar manner to activating the direct injector at 318, deactivating the direct injector at 324 may include not delivering fuel until an injection profile includes delivering at least some fuel via direct injection, or until the DI fuel rail pressure again reaches the upper threshold pressure.

At 326, method 300 may include maintaining combustion with the port injection fuel system. In some examples, 326 may include selecting a new injection profile based on engine operating conditions, similar to the selection at 304. It will be understood that direct injection may be activated at a later time when engine operating conditions indicate that direct injection is desired (e.g., when exhaust cooling is desired). As described above with reference to 312, the port injection fuel system may be used throughout the running duration of method 300 in order to maintain combustion during periods where the direct injection fuel system is not in use. After 326, routine 300 terminates.

Method 300 or other equivalent methods may be independently or as a subroutine for another engine operating method. Method 300 may be executed repeatedly throughout the course of operating a vehicle, or may be run when specific operating conditions are confirmed.

One example method for adjusting the lower fuel rail pressure threshold is shown at routine 400 of FIG. 4. In one example, determining a lower fuel rail pressure threshold may include determining an amount of fuel to deliver to the engine via direct injection during conditions where only port injection is requested/commanded. Thus, determining the lower fuel rail pressure threshold may include determining a maximum amount of fuel that may be directly injected while maintaining engine performance within a desired range. In some examples, determining a lower fuel rail pressure threshold may include determining amounts of fuel to directly inject across a number of combustion events, and thus may include determining an injection profile with which to inject fuel until the DI fuel rail pressure has reached the lower threshold pressure. It will be appreciated that port fuel injection may be maintained throughout the delivery of stagnant fuel from the direct injection fuel rail via direct injection.

As another example, determining the lower fuel rail pressure may include determining a minimum desired direct injection mass. For example, if a vehicle controller determines that large direct injection masses may be desirable when direct injection is re-enabled (e.g., based on engine speed-load conditions), the lower fuel rail pressure may be higher to ensure that a desired injection mass may be achieved. As another example, if a vehicle controller anticipates that smaller direct injection masses are desirable when direct injection is re-enabled, the lower fuel rail may be lower so that a minimum injection mass corresponding to a minimum injection pulse-width may be achieved.

Turning now to FIG. 4, routine 400 begins at 402 where engine operating conditions and engine history may be retrieved from memory (e.g., ROM 106 of controller 12 at FIG. 1) and/or measured. As one example, at 402 the engine controller may retrieve current speed-load conditions, pre-ignition history (e.g., an engine pre-ignition count), engine knock history (e.g., an engine knock count), EGR conditions, a current particulate matter load, one or more current exhaust temperatures (e.g., from one or more of exhaust sensors 126 and 144 at FIG. 1), exhaust catalyst conditions, and a history of lower fuel rail pressure thresholds previously applied. Additionally, if a current value for one or more of the aforementioned parameters is not available in memory, said parameters may be measured at 402.

At 404, an initial lower threshold fuel rail pressure may be determined based on an engine speed-load map. For example, the engine speed and engine load values estimated at 402 may be used in combination with a speed-load map stored in the controller's memory that may map a coordinate in speed-load space to a desired amount of directly injected fuel. As one example, the lower threshold increases with increased engine speed, and decreases with decreased engine speed. Additionally, the lower threshold may increase] with increased engine load, and decrease with decreased engine load. This desired amount of directly injected fuel may correlate to a difference between the current fuel rail pressure (at the upper threshold pressure) and a desired lower threshold pressure. In this way, by determining a lower threshold fuel rail pressure based on engine speed-load conditions, degradation of the fuel injectors due to high pressures may be reduced while also limiting an amount of direct injection during conditions wherein port fuel injection is preferred. In addition, the lower threshold may be adjusted to be above a pressure where the high pressure pump has to be re-enabled.

In some examples, determining the lower pressure threshold at 404 may include adjusting a previously determined lower threshold value (e.g., the lower threshold value retrieved from memory at 402, as determined during a preceding execution of routine 400) toward the value determined via the speed-load map during the current execution of routine 400. For example, the lower threshold pressure determined at 404 may be filtered into the previous lower threshold value via a regression technique. In this way, the lower threshold value may be steadier across time.

Continuing now to 406, a pre-ignition history of the engine is retrieved, including for example, an engine pre-ignition count representing a number of pre-ignition events that have occurred in the engine over a drive cycle. If the engine pre-ignition count is higher than a threshold, it may be determined that the engine (or specific cylinders therein) is prone to pre-ignition. Accordingly, it may be desirable to increase the amount of directly injected fuel to reduce the likelihood of future pre-ignition events. If it is determined that the pre-ignition count of the engine is higher than the threshold, routine 400 proceeds to 408. Otherwise, routine 400 proceeds to 410.

At 408, the lower fuel rail pressure threshold may be adjusted in response to the engine pre-ignition count. As one example, the lower fuel rail pressure threshold may be increased in response to an engine pre-ignition count greater than a threshold count (e.g., one). As an example result, the amount of fuel that is directly injected in response to a direct injection fuel rail pressure reaching an upper threshold is increased. As another example, the lower fuel rail pressure may be decreased in response to an engine pre-ignition count greater than a threshold count (e.g., one). As an example result, the amount of fuel that is directly injected in response to the direct injection fuel rail pressure reaching the upper threshold is decreased. In this way, fuel injector degradation may be reduced while reducing the likelihood of a pre-ignition event. After 408, routine 400 proceeds to 410.

At 410, the engine knock history is retrieved and it is determined whether an engine knock count is higher than a threshold. For example, it may be determined if the engine history includes knock events at the current speed-load conditions. Additionally, current engine operating conditions may be used to predict whether knock may occur upon injecting fuel into the combustion chamber. For example, under conditions where exhaust temperature may become elevated, an engine (or a cylinder thereof) may become prone to engine knock events. If a threshold number of knock events have elapsed, and the engine knock count is higher than a threshold, it may be desirable to increase the amount of directly injected fuel to reduce the likelihood of further engine knock events. If it is determined that the engine knock count is higher than a threshold, routine 400 proceeds to 412. Otherwise, routine 400 proceeds to 414.

At 412, the lower fuel rail pressure threshold may be increased in response to operating at engine speed-load conditions that are prone to knock events. Consequently, the amount of fuel that is directly injected in response to a direct injection fuel rail pressure reaching an upper threshold is decreased. In this way, fuel injector degradation may be reduced while maintaining a larger amount of fuel in the DI fuel rail to inject in response to future engine knock events. Thus, by increasing the lower fuel rail pressure threshold in response to engine speed-load conditions that are prone to knock events, engine performance may be increased. After 412, routine 400 proceeds to 414.

At 414, it may be determined if there are any EGR limitations. For example, it is determined whether to adjust the lower threshold based on EGR constraints. For example, during low speed and medium load conditions, cooled-EGR may be limited. For example, there may be a delay in attaining the desired amount of cooled-EGR. Herein, the cooled-EGR limitation may be addressed by adjusting the lower fuel rail pressure threshold. If adjusting the lower fuel rail pressure threshold is desired based on EGR conditions, routine 400 may proceed to 416. Otherwise, routine 400 proceeds to 418.

At 416, the lower fuel rail pressure threshold may be adjusted to a lower value in response to an EGR limitation. As a result, the amount of fuel that is directly injected in response to a direct injection fuel rail pressure reaching an upper threshold may be increased. As another example the lower fuel rail pressure threshold may be adjusted to a higher value in response to an EGR limitation. As a result, the amount of fuel that is directly injected in response to a direct injection fuel rail pressure reaching an upper threshold may be decreased. In this way, fuel injector degradation may be reduced while further cooling recirculated exhaust gas, thereby increasing engine performance. Alternatively at 416, in response to the cold-EGR limitation, the number of combustion events for which the direct injectors are activated may be increased or decreased while not adjusting the lower pressure threshold. In this way, EGR may be provided across a desired number of combustion events. After 416, routine 400 proceeds to 418.

Continuing now to 418, it is determined whether the load of an exhaust particulate matter (PM) filter (e.g., emission control device 72 at FIG. 1) is above a threshold load. It will be appreciated that a PM filter load may herein also be referred to as a soot load. As one example, delivering fuel to the engine via direct injection may result in increased amounts of unburned fuel, particularly during high speed and/or high engine load conditions, thereby increasing soot emissions. If the soot load of the PM filter is at or above a threshold load, the increased soot emissions may not be adequately captured by the filter and thus may be introduced to the atmosphere. Thus, during conditions wherein the soot load is above the threshold load, directly injecting fuel to reduce the pressure within the DI fuel rail may be less desirable. If the soot load is above the threshold load, routine 400 may proceed to 420 to adjust the lower threshold pressure based on soot load. Otherwise routine 400 may proceed to 422.

At 420, the lower fuel rail pressure threshold may be adjusted based on the soot load of the PM filter. For example, the lower fuel rail pressure threshold may be increased in response to the soot load being above the threshold value. Consequently, the amount of fuel that is directly injected in response to a direct injection fuel rail pressure reaching an upper threshold is reduced. In another example, during high speed and/or high engine load conditions the lower fuel rail pressure threshold may be adjusted based on soot load whether or not the soot load is above the threshold load. In this example, as soot load increases, the adjusted lower pressure threshold may increase, thereby providing less fuel via direct injection during higher soot load conditions. It will be appreciated that providing less fuel via direct injection may include reducing a total amount of fuel delivered from the fuel rail from a first amount to a second amount, or may include injecting the first amount of fuel across a larger number of combustion events to reduce the amount of fuel injected during each combustion event. In this way, fuel injector degradation may be reduced while reducing soot emissions. After 420, routine 400 proceeds to 422.

At 422, exhaust temperature is compared to a threshold exhaust temperature. Specifically, at high load and high speed conditions, exhaust temperatures may be elevated. In one example, exhaust temperature (e.g., as measured by an exhaust temperature sensor) may be compared to a first threshold exhaust temperature. The first threshold exhaust temperature may be an upper threshold above which catalyst performance may degrade (e.g., the catalyst within TWC 71 at FIG. 1). Thus, the first threshold exhaust temperature may be based on a catalyst type and configuration. In another example, a temperature of exhaust recirculated via the HP-EGR loop (e.g., as measured by EGR sensor 144) may be compared to a second threshold exhaust temperature. The second threshold exhaust temperature may be an upper threshold above which degradation of turbine performance may occur (e.g., turbine 164 at FIG. 1). If one or more exhaust temperatures is above a threshold exhaust temperature, routine 400 proceeds to 424. Otherwise, routine 400 proceeds to 425.

At 424, the lower threshold may be adjusted based on one or more of the exhaust temperatures described above with regard to 422. For example, the lower fuel rail pressure threshold may be decreased in response to an exhaust temperature above a corresponding threshold temperature. Put another way, the amount of fuel that is directly injected in response to a direct injection fuel rail pressure reaching an upper threshold is increased. Thus, to curb highly elevated exhaust temperatures, lower fuel rail pressure threshold may be adjusted to the lower value (e.g., the direct injection amount associated with the lower threshold pressure may be increased to a higher value). In the case of a boosted engine, reduction of exhaust temperatures may also help to reduce a turbine inlet temperature, thereby reducing turbocharger durability issues. As such, delivering more fuel via direct injection may lead to a temporary drop in volumetric fuel economy, however, that may be accepted in view of the DI fuel rail pressure limitations and the exhaust temperature limitations. As another example, exhaust temperatures may be curbed by adjusting (e.g., retarding) a direct injection timing to deliver uncombusted fuel to the exhaust passageways. After 424, routine 400 proceeds to 425.

In some examples, the adjusted lower threshold pressure determined at 422 and/or 424 may optionally be adjusted based on characteristics of the fuel system. As one example, a lower bound may be placed on the lower threshold pressure, said lower bound based on the pressure at which the high pressure pump must be reactivated (e.g., must direct more pressurized fuel toward the direct injection fuel rail) before activating the direct injectors. Put another way, the lower bound may a pressure below which the high pressure fuel pump must enabled for any subsequent direct injections. With reference to fuel system 200 at FIG. 2, this lower bound may be based on the outlet pressure of high pressure fuel pump 214, in addition to the characteristics of direct injectors 252. Put another way, the lower bound may be the lowest fuel rail pressure for which predictable amounts of fuel may be delivered to the engine via direct fuel injection.

After one of 422 or 424, if the lower fuel rail pressure threshold is less than this lower bound, the threshold pressure may be clipped to the lower bound at 425. In another example, the threshold pressure may be adjusted to be at least a predetermined amount of pressure above this lower bound. By adjusting the threshold pressure to at least the predetermined amount of pressure above the lower bound, reactivating the high pressure fuel pump may be avoided in the event of a fueling error during the lowering of the fuel pressure within the DI fuel rail. As one example, the predetermined amount may be an injection command uncertainty associated with each specific direct injector. After 425, routine 400 proceeds to 426.

At 426, the adjusted lower fuel rail pressure threshold may be applied as the lower fuel rail pressure threshold in a higher-order injector control routine (e.g., routine 300 at FIG. 3). It will be appreciated that applying the lower pressure threshold may further include storing the adjusted lower threshold in the controller memory for a later adaptation. As an example, during a subsequent execution of routine 400, the adjusted lower threshold may be retrieved from memory at 402 and may be used to determine the subsequent lower threshold pressure at 404. After 426, routine 400 may return to a higher-level injector control routine, or alternately may terminate.

FIG. 5 depicts a graphical representation of timeline 500 for engine operation and for the operation of a direct fuel injector (e.g., one of direct injectors 252 at FIG. 2) based on a direct injection fuel rail pressure. As one example, the engine operation represented at timeline 500 is representative of operating the engine 10 at FIG. 1 with fuel system 200 at FIG. 2, according to routines 300 and 400 shown respectively at FIGS. 3 and 4. Timeline 500 includes graphical representation of fuel flow through the direct injector, shown by trace 512 at plot 510. Trace 512 is depicted as representing two operating conditions, fuel flow greater than 0 (e.g., substantially greater than zero) and fuel flow equal to 0 (e.g., substantially equal to zero). It will be appreciated that for the entire duration of the direct injector adaptation, the engine is fueled via port injection.

Timeline 500 further includes graphical representation of DI fuel rail pressure, shown by trace 522 at plot 520. The Y axis represents direct injection fuel rail pressure (e.g., fuel rail pressure within DI fuel rail 250 as measured by pressure sensor 248 shown at FIG. 2), and pressure increases in the direction of the Y axis arrow. An upper fuel rail pressure threshold is shown by line 521, and a lower fuel rail pressure threshold is shown by line 523. For example, threshold 521 may be the upper threshold described above with regards to 308 depicted in FIG. 3. Additionally, threshold 523 may be the lower threshold described above with regard to 316 depicted in FIG. 3. In particular, the variation of threshold 523 across time may be a result of the adjusting described with regard to routine 400 at FIG. 4.

Timeline 500 further includes graphical representation of a soot load, shown by line 530. The Y axis represents a soot load amount (e.g., as determined via soot load signal PM, and measured by soot load sensor 198 shown at FIG. 1), and the soot load increases in the direction of the Y axis arrow. An upper threshold for soot load is shown by line 531. For example, soot load may be an example engine parameter used to adjust the lower threshold 523, as discussed with regard to 418 and 420 at FIG. 4.

Timeline 500 further includes a graphical representation of engine speed, shown by trace 542 at plot 540. The Y axis represents, for example, rotational frequency of a crankshaft (e.g., as measured by Hall effect sensor 120 shown at FIG. 1), and frequency increases in the direction of the Y axis arrow. For example, engine speed, along with engine load (not shown), may be an example engine parameter used to determine an initial value for lower threshold 523, as discussed with regard to 404 at FIG. 4.

Vertical markers t0-t12 represent times of interest during the operating sequence. As one example, the direct injector is intermittently activated. Specifically, the direct injector is activated and/or injecting fuel during the intervals spanning from times t0-t1, t2-t3, t5-t6, t7-t8, t10-t11, and t12 onward and the direct injector is deactivated during the intervals spanning from times t1-t2, t3-t5, t6-t7, t8410, and t11-t12. Thus, during the intervals spanning from times t1-t2, t3-t5, t6-t7, t8-t10, and t11-t12, the engine cylinder may be operated with only port fuel injection. It will be appreciated that before time t1 and after time t12, fuel may be delivered to the engine cylinder via each of port injection and direct injection according to engine operating conditions, or alternately may be delivered to the engine cylinder via only direct injection according to engine operating conditions.

At time t0, DI fuel flow rate is not greater than 0. Between time t0 and time t1, the DI fuel flow rate alternates between being greater than 0 and being equal to 0. During periods where there DI fuel flow rate is not greater than zero, DI fuel rail pressure may increase. During conditions wherein the DI fuel flow rate is greater than zero, DI fuel rail pressure may decrease. Also between time t0 and t1, lower pressure threshold 523 may above a pressure at which a high pressure fuel pump must be enabled before subsequent direct injection is allowed.

At time t1, direct fuel injection stops. For example, with reference to 304 at FIG. 3, a fuel profile may be selected that includes injecting fuel via only PFI. Thus, at time t1, the direct injector is deactivated while the port injector is maintained activated (not shown).

From time t1 to time t2, DI fuel flow is equal to 0. In other words, the direct injection system is not in use (e.g., deactivated), and the engine may maintain combustion by operating the port fuel injection system. Additionally, fuel may stagnate in the DI fuel rail, thereby causing an increase in DI fuel rail pressure 522. As one example, due to the rigid nature of the fuel rail, DI fuel rail pressure may increase accordingly with fuel rail temperature (not shown). In other words, DI fuel rail pressure may increase during conditions wherein a bulk fuel flow through the direct injector is substantially equal to zero.

At time t2, fuel rail pressure 522 reaches upper threshold 521. In response to the DI fuel rail temperature exceeding upper threshold 521, DI fuel flow is commanded to be greater than 0. Put another way, direct injection is initiated in response to direct injection fuel rail pressure rising above the upper threshold. Thus, at time t2, the direct injectors are transiently activated in response to a fuel pressure increase at the fuel rail coupled to the direct injector. Additionally at time t2, lower threshold 523 increases based on engine speed-load conditions. For example, the value may be chosen based on a low-speed medium-load condition.

Between times t2 and t3, fuel is delivered to a combustion cylinder via direct injection. As one example, the duration between times t2 and t3 comprises a single direct injection within a single cylinder combustion event. As one example, the single direct injection may be during an intake stroke of the combustion event. As another example, the single direct injection may be during a compression stroke of the combustion event. Accordingly, fuel pressure 522 decreases in response to the direct injection event.

At time t3, the fuel pressure 522 decreases to lower threshold 523. In response to the fuel pressure decrease at or below the lower threshold 523, the direct injector is deactivated. Put another way, fuel flow through the direct injector is decreased. Thus the transient activation of the direct injector at t2 is ended via the deactivation of the direct injector at time t3. It will be appreciated that fuel flow through the port injector, and from a fuel pump (e.g., a high pressure fuel pump inlet) to a fuel rail coupled to the port injector, may each remain substantially greater than zero at time t3.

From time t3 to time t5, DI fuel flow is equal to 0. Thus fuel may stagnate in the DI fuel rail, thereby causing an increase in DI fuel rail pressure 522. As one example, due to the rigid nature of the fuel rail, DI fuel rail pressure may increase accordingly with fuel rail temperature (not shown).

At time t4, a pre-ignition event occurs. An engine controller may detect the event via a pre-ignition detection, and may store the occurrence of the event within a pre-ignition history of the engine.

At time t5, fuel pressure 522 again reaches upper threshold 521. In response to the DI fuel rail temperature exceeding upper threshold 521, DI fuel flow is commanded to be greater than 0. Put another way, direct injection is initiated in response to direct injection fuel rail pressure rising above the upper threshold. Thus, at time t5, the direct injectors are transiently activated in response to a fuel pressure increase at the fuel rail coupled to the direct injector. Additionally at time t5, lower threshold 523 is adjusted based on engine operating conditions. Specifically, based on the pre-ignition history in the current engine-speed load range (e.g., the pre-ignition event at t4), the lower threshold decreases to allow for more fuel to be delivered via direct injection. It will be appreciated the decrease in the lower threshold may be an adjustment from an initial lower threshold determined via engine speed-load conditions, as discussed with regard to routine 400 at FIG. 4.

Between times t5 and t6, fuel is delivered to a combustion cylinder via direct injection. As one example, the duration between times t5 and t6 comprises multiple intake and compression stroke direct injections. As one example, the delivery of fuel includes a compression stroke direct injection and an intake stroke direct injection within a common combustion event. As another example, the delivery of fuel includes a compression stroke direct injection during a first combustion event and an intake stroke direct injection during a second combustion event. As another example, the delivery of fuel includes two intake or compression stroke direct injections, either during a common intake or compression stroke or during first and second intake or compression strokes of first and second combustion events. Accordingly, fuel pressure 522 decreases in response to the direct injection events.

At time t6, the fuel pressure 522 decreases to lower threshold 523. In response to the fuel pressure decrease at or below the lower threshold 523, the direct injector is deactivated. Put another way, fuel flow through the direct injector is decreased. Thus the transient activation of the direct injector at t5 is ended via the deactivation of the direct injector at time t6. It will be appreciated that fuel flow through the port injector, and from a fuel pump (e.g., a high pressure fuel pump inlet) to a fuel rail coupled to the port injector, may each remain substantially greater than zero at time t6.

From time t6 to time t7, DI fuel flow is equal to 0. Thus fuel may stagnate in the DI fuel rail, thereby causing an increase in DI fuel rail pressure 522. Also from time t6 to t7, engine speed increases.

At time t7, fuel pressure 522 again reaches upper threshold 521. In response to the DI fuel rail temperature exceeding upper threshold 521, direct injection is initiated in response to direct injection fuel rail pressure rising above the upper threshold. Additionally at time t7, lower threshold 523 is adjusted based on engine operating conditions. Specifically, lower threshold 523 decreases based on the increasing engine speed. It will be appreciated that lower threshold 523 may also decrease based on a decreasing engine load (not shown). It will be appreciated the decrease in the lower threshold may be further adjusted at time t7 based on a number of engine operating conditions, as discussed herein and with regard to routine 400 at FIG. 4.

Operation of the direct injection system continues from time t7 to time t8, and the increase in fuel flow through the direct injector is sufficient to reduce the temperature and pressure of the DI fuel rail such that the pressure of the DI fuel rail drops below threshold 523. At time t8, the direct injectors are deactivated.

From time t8 to t9, soot load 532 increases and reaches an upper threshold load 531 at time t9. Additionally, from time t8 to time t10, DI fuel flow is equal to 0. Thus fuel may stagnate in the DI fuel rail, thereby causing an increase in DI fuel rail pressure 522. As one example, due to the rigid nature of the fuel rail, DI fuel rail pressure may increase accordingly with fuel rail temperature (not shown).

At time t10, fuel pressure 522 again reaches upper threshold 521. In response to the DI fuel rail temperature exceeding upper threshold 521, direct injection is initiated in response to direct injection fuel rail pressure rising above the upper threshold. Additionally at time t10, lower threshold 523 is adjusted based on engine operating conditions. Specifically, lower threshold 523 increases based on the soot load 532 above upper threshold 531. It will be appreciated the increase in lower threshold 523 at time t10 may be an adjustment from an initial lower threshold determined via engine speed-load conditions, as discussed with regard to routine 400 at FIG. 4.

Operation of the direct injection system continues from time t10 to time t11, and the increase in fuel flow through the direct injector is sufficient to reduce the temperature and pressure of the DI fuel rail such that the temperature of the DI fuel rail drops below upper threshold 524 and is reduced to lower threshold 523. At time t11, the direct injector is again deactivated.

From time t11 to time t12, DI fuel flow is equal to 0. Thus fuel may stagnate in the DI fuel rail, thereby causing an increase in DI fuel rail pressure 522. At time t12, the direct injector is activated while DI fuel rail pressure 522 remains below upper threshold 521. Specifically, engine operating conditions may indicate that direct injection is desired at time t12 (e.g., as described with regard to 302 and 304 at FIG. 3). Thus, after time t12, fuel may be delivered to the engine cylinder via each of direct injection and port injection. In other examples, fuel may be delivered to the engine cylinder via only direct injection. It will be appreciated that at time t12, lower pressure threshold 523 may adjusted, but may remain above a pressure at which a high pressure fuel pump must be enabled before subsequent direct injection is allowed.

In a first example, a method is contemplated, comprising: while operating an engine cylinder with fuel from only a first injector, transiently activating the second injector to inject fuel into the cylinder in response to a fuel pressure increase at a fuel rail coupled to the second injector, and deactivating the second injector in response to a fuel pressure decrease at the fuel rail below a lower threshold, the lower threshold adjusted based on one or more engine operating conditions. In a first embodiment of the first example method, the transiently activating may include activating the second injector in response to the fuel pressure increase at the fuel rail above an upper threshold, the upper threshold based on fuel rail rigidity. In a second embodiment, which optionally includes the first embodiment, the fuel rail coupled to the second injector is a second fuel rail different from a first fuel rail coupled to the first injector. In a third embodiment, which optionally includes one or more of the first and second embodiments, each of the first and second fuel rails may be pressurized by a common high pressure fuel pump, and during the transiently activating and deactivating, the high pressure fuel pump may be disabled. In a fourth embodiment, which optionally includes one or more of the first through third embodiments, the lower threshold may be adjusted to remain above a pressure at which the high pressure fuel pump is enabled. In a fifth embodiment, which optionally includes one or more of the first through fourth embodiments, the first example may further comprise adjusting injection of fuel from the first injector responsive to fuel injected by the second injector while the second injector is transiently activated. In a sixth embodiment, which optionally includes one or more of the first through fifth embodiments, the transiently activating may be further based on a coefficient of thermal expansion of fuel in the second fuel rail. In a seventh embodiment, which optionally includes one or more of the first through eight embodiments, the lower threshold may be adjusted based on an estimated soot load, the lower threshold increasing with increasing soot load. In an eighth embodiment, which optionally includes one or more of the first through seventh embodiments, the lower threshold may be adjusted based on an engine speed-load condition, the lower threshold decreasing with increased engine speed and increasing load. In a ninth embodiment, which optionally includes one or more of the first through eighth embodiments, the first fuel injector is a port injector, and the second fuel injector is a direct injector. In a tenth embodiment, which optionally includes one or more of the first through ninth embodiments, the example method may further comprise adjusting a parameter of a cooling system coupled to the fuel rail in response to a rail pressure increase of the fuel rail, the parameter including one of a flow rate and temperature of coolant.

In a second example, a method for an engine is contemplated, comprising: while operating an engine cylinder with only port fuel injection, intermittently injecting fuel stagnating in a direct injection fuel rail into the cylinder, the intermittently injecting including initiating injection when a direct injection fuel rail pressure rises above an upper threshold and discontinuing the injection when a direct injection fuel rail pressure falls below a lower threshold, the lower threshold adjusted based on engine operating conditions including exhaust soot level and engine pre-ignition history. In a first embodiment of the second example, continuing the injection may include delivering fuel as a single direct injection per cylinder combustion event. In a second embodiment, which optionally includes the first embodiment, initiating injection includes delivering the fuel as a single direct injection during an intake stroke. In a third embodiment, which optionally includes one or more of the first and embodiments, initiating injection includes delivering the fuel as a single direct injection during a compression stroke. In a fourth embodiment, which optionally includes one or more of the first through third embodiments, initiating injection includes delivering the fuel as multiple intake and compression stroke direct injections. In a fifth embodiment, which optionally includes one or more of the first through fourth embodiments, the lower threshold is further adjusted to maintain direct fuel injections above a minimum injection mass. In a sixth embodiment, which optionally includes one or more of the first through fifth embodiments, the lower threshold is further adjusted based on an NVH limit of engine. In a seventh embodiment, which optionally includes one or more of the first through sixth embodiments, the lower threshold may be adjusted in real time based on a rate of decrease in direct injection fuel rail pressure during the intermittent injecting.

In a third example, a fuel system for an internal combustion engine is contemplated, comprising: a port fuel injector in communication with a cylinder, a direct fuel injector in communication with the cylinder, a first fuel rail in communication with the port injector, a second fuel rail in communication with the direct injector, a high-pressure fuel pump in communication with each of the first and second fuel rail, and a control system configured with computer-readable instructions stored on non-transitory memory for: during a first condition, when a pressure in a fuel included in the second fuel rail exceeds an upper threshold, increasing flow of fuel through the direct fuel injector; during a second condition, when a pressure in a fuel included in the second fuel rail falls below a lower threshold, decreasing the flow of fuel through the direct fuel injector; and during both the first and second conditions, delivering fuel to the cylinder via the port fuel injector. In a first embodiment of the third example, the first condition includes a bulk fuel flow through the direct fuel injector being substantially equal to zero. In a second embodiment, which optionally includes the first embodiment, the high pressure fuel pump includes a high pressure fuel pump inlet coupled to the first fuel rail, and a high pressure fuel pump outlet coupled to the second fuel rail. In a third embodiment, which optionally includes one or more of the first and second embodiments, both of the first and second conditions include a bulk fuel flow from the high pressure fuel pump outlet to the second fuel rail being substantially equal to zero. In a fourth embodiment, which optionally includes one or more of the first through third embodiments, both of the first and second conditions include a bulk fuel flow from the high pressure fuel pump inlet to the first fuel rail being substantially greater than zero.

The technical effect of delivering fuel from the direct injection fuel rail when fuel pressure at the DI fuel rail is above a threshold pressure, is reduced direct injector degradation. By delivering fuel from the DI fuel rail until the pressure at the DI fuel rail reaches a lower threshold adjusted based on engine operating conditions is that engine performance may be improved. The technical effect of maintaining the lower threshold above a pressure at which fuel flow from the high pressure pump to the DI fuel rail must be enabled is to reduce NVH issues of the engine. The technical effect of adjusting the lower threshold based on engine operating conditions is to maintain a desired minimum injection mass when the direct injectors are reactivated.

It will be appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

via a controller with computer-readable instructions stored on non-transitory memory, while operating an engine cylinder with fuel from a first injector, activating a second injector to inject stagnated fuel from a fuel rail coupled to the second injector into the cylinder in response to a fuel pressure increase at the fuel rail, the stagnated fuel being stagnate due to a condition of fuel flow to the fuel rail being substantially equal to zero; and deactivating the second injector in response to a fuel pressure decrease at the fuel rail below a lower threshold, the lower threshold adjusted based on one or more engine operating conditions.

2. The method of claim 1, wherein the activating includes activating the second injector in response to the fuel pressure increase at the fuel rail above an upper threshold.

3. The method of claim 2, wherein the fuel rail coupled to the second injector is a second fuel rail different from a first fuel rail coupled to the first injector.

4. The method of claim 3, wherein each of the first and second fuel rails is pressurized by a high pressure fuel pump, and wherein during the activating and deactivating, the fuel flow into the second fuel rail from the high pressure fuel pump is disabled.

5. The method of claim 4, wherein the lower threshold is adjusted to remain above a pressure at which the fuel flow from the high pressure fuel pump to the second fuel rail is enabled.

6. The method of claim 5, further comprising, while the second injector is activated, adjusting injection of fuel from the first injector responsive to fuel injected by the second injector.

7. The method of claim 3, wherein the activating is further based on a coefficient of thermal expansion of the stagnated fuel in the second fuel rail, and wherein the lower threshold is adjusted based on engine pre-ignition history.

8. The method of claim 7, wherein the lower threshold is adjusted based on an estimated exhaust soot load, the lower threshold increasing with increasing exhaust soot load.

9. The method of claim 7, wherein the lower threshold is adjusted based on an engine speed-load condition, the lower threshold increasing with increased engine speed and increasing load.

10. The method of claim 9, wherein the first injector is a port injector, and the second fuel injector is a direct injector.

11. A method for an engine comprising:

while port fueling an engine cylinder with direct injection disabled and stagnated fuel from there being substantially zero fuel flow to a direct injection fuel rail, activating a direct injector to intermittently direct inject fuel from the direct injection fuel rail into the cylinder, the intermittently direct injecting including initiating direct injection when a direct injection fuel rail pressure rises above an upper threshold and continuing the direct injection until the direct injection fuel rail pressure falls below a lower threshold, the lower threshold adjusted based on engine operating conditions, the engine operating conditions including at least one of exhaust soot level and engine pre-ignition history.

12. The method of claim 11, wherein continuing the direct injection includes delivering fuel as a single direct injection per cylinder combustion event.

13. The method of claim 12, wherein the direct injecting includes delivering the fuel as a single direct injection during an intake stroke or a compression stroke.

14. The method of claim 12, wherein the direct injecting includes delivering the fuel as multiple direct injections in at least one of an intake stroke and a compression stroke.

15. A fuel system for an internal combustion engine, comprising:

a port fuel injector in communication with a cylinder;

a direct fuel injector in communication with the cylinder;

a first fuel rail in communication with the port fuel injector;

a second fuel rail in communication with the direct fuel injector;

a high-pressure fuel pump in communication with each of the first and second fuel rails; and a control system configured with computer-readable instructions stored on non-transitory memory for:

delivering fuel to the cylinder via the port fuel injector with the direct fuel injector disabled and stagnated fuel from there being no fuel flow to the second fuel rail; and during a first condition, when a pressure of the stagnated fuel in the second fuel rail exceeds an upper threshold, increasing flow of fuel through the direct fuel injector by activating the direct fuel injector; and during a second condition, when a pressure of the stagnated fuel in the second fuel rail falls below a lower threshold, decreasing the flow of fuel through the direct fuel injector by deactivating the direct fuel injector.

16. The system of claim 15, where the first condition includes a bulk fuel flow through the direct fuel injector being zero.

17. The system of claim 16, wherein the high pressure fuel pump includes a high pressure fuel pump inlet coupled to the first fuel rail, and a high pressure fuel pump outlet coupled to the second fuel rail.

18. The system of claim 17, wherein both of the first and the second conditions include a bulk fuel flow from the high pressure fuel pump outlet to the second fuel rail being zero.

19. The system of claim 18, wherein both of the first and the second conditions include a bulk fuel flow from the high pressure fuel pump inlet to the first fuel rail being greater than zero.

20. The method of claim 11, further comprising adjusting a parameter of a cooling system coupled to the direct injection fuel rail responsive to an increase in the direct injection fuel rail pressure, the parameter including one of a flow rate and temperature of coolant.

* * * * *